US012281428B2

(12) United States Patent
Choe et al.

(10) Patent No.: US 12,281,428 B2
(45) Date of Patent: Apr. 22, 2025

(54) LAUNDRY TREATMENT APPARATUS AND CONTROL METHOD THEREOF

(71) Applicant: LG Electronics Inc., Seoul (KR)

(72) Inventors: Woon Je Choe, Seoul (KR); Do Wan Kim, Seoul (KR); Boo Sung Kim, Seoul (KR); Se Jin Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 803 days.

(21) Appl. No.: 17/218,979

(22) Filed: Mar. 31, 2021

(65) Prior Publication Data

US 2021/0301447 A1 Sep. 30, 2021

(30) Foreign Application Priority Data

Mar. 31, 2020 (KR) ..... 10-2020-0039306

(51) Int. Cl.

| | |
|---|---|
| ***D06F 33/68*** | (2020.01) |
| ***D06F 29/00*** | (2006.01) |
| ***D06F 34/04*** | (2020.01) |
| ***D06F 34/18*** | (2020.01) |
| *D06F 101/20* | (2020.01) |
| *D06F 103/04* | (2020.01) |

(52) U.S. Cl.

CPC ..... *D06F 33/68* (2020.02); *D06F 29/005* (2013.01); *D06F 34/04* (2020.02); *D06F 34/18* (2020.02); *D06F 2101/20* (2020.02); *D06F 2103/04* (2020.02)

(58) Field of Classification Search

CPC ..... D06F 33/38

See application file for complete search history.

(56) References Cited

U.S. PATENT DOCUMENTS

| | | | |
|---|---|---|---|
| 2018/0209084 | A1 | 7/2018 | Chakravarty |
| 2018/0230640 | A1 | 8/2018 | Bilionis et al. |
| 2020/0002873 | A1 | 1/2020 | Chae et al. |
| 2020/0024784 | A1 | 1/2020 | Yoon et al. |

FOREIGN PATENT DOCUMENTS

| | | | |
|---|---|---|---|
| DE | 19802649 | A1 | 7/1999 |
| DE | 10-2017-211716 | A1 | 1/2019 |
| DE | 102018100442 | A1 | 7/2019 |
| EP | 1433894 | | 6/2004 |
| EP | 1657341 | A2 | 5/2006 |

OTHER PUBLICATIONS

EP Extended European Search Report in European Appln. No. 21165829.9, dated Jun. 14, 2021, 7 pages.

Extended European Search Report in European Appln. No. 24176558.5, mailed on Oct. 9, 2024, 6 pages.

Partial European Search Report in European Appln No. 24176558.5, mailed on Jul. 18, 2024, 10 pages.

*Primary Examiner* — Jason Y Ko

(74) *Attorney, Agent, or Firm* — Fish & Richardson P.C.

(57) ABSTRACT

Disclosed is a method of controlling a washing machine. The method includes receiving setting information for washing mode, sensing an amount of laundry put into the washing machine, transmitting the setting information for washing mode and information on the amount of laundry to a dryer, and transmitting preheating request information to the dryer. A laundry treatment apparatus includes devices that may operate in conjunction with one another, thereby increasing operation efficiency and usability.

10 Claims, 11 Drawing Sheets

LAUNDRY TREATMENT APPARATUS AND CONTROL METHOD THEREOF

CROSS-REFERENCE TO RELATED APPLICATION

This application claims the benefit of Korean Patent Application No. 10-2020-0039306, filed on Mar. 31, 2020, the disclosure of which is incorporated herein in its entirety by reference.

TECHNICAL FIELD

The present disclosure relates to a laundry treatment apparatus and a control method thereof, and one particular implementation relates to a control method for performing at least a part of a washing process and a drying process in parallel to exchange information between a washing machine and a dryer, and a laundry treatment apparatus using the same.

BACKGROUND

The laundry treatment apparatus is a generic term for an apparatus for washing clothes, an apparatus for drying clothes, and an apparatus capable of washing and drying clothes.

There is a conventional laundry treatment apparatuses including a dryer for drying clothes, a washing machine for washing clothes, and a shelf providing a space in which one of the dryer and washing machine may be positioned above the other. A laundry treatment apparatus having a dryer or a washing machine stacked on the shelf in the vertical direction of the shelf has an advantage in that the washed clothes may be easily transferred from the washing machine to the dryer.

However, in the above-described conventional laundry treatment apparatus, since a controller provided in the dryer and a controller provided in the washing machine operate with independent circuits, it is disadvantageous that one apparatus may not control the other apparatus. Therefore, there is a disadvantage for a user that the user needs to proceed in person with the process of supplying power to the other apparatus when the operation of either the washing machine or the dryer is completed, and the process of inputting a control command. It is also disadvantageous that each apparatus needs to separately perform sensing related to laundry.

SUMMARY

An aspect provides a control method for performing an interlocked operation through information exchange between a washing machine and a dryer in a laundry treatment apparatus, and a laundry treatment apparatus using the same.

Another aspect provides a method of controlling a dryer so that laundry-related information is provided to the dryer from a washing machine operating in a set mode and effective drying is performed immediately after washing is finished, and a laundry treatment apparatus using the same.

According to an aspect, there is provided a control method of a washing machine including receiving washing mode setting information, sensing an amount of laundry put into the washing machine, transmitting the washing mode setting information and information on the amount of laundry to a dryer, and transmitting preheating request information to the dryer.

According to another aspect, there is also provided a control method of a dryer including receiving washing mode setting information and information on a laundry amount from a washing machine, receiving preheating request information from the washing machine, and driving a compressor and a fan based on the preheating request information.

According to another aspect, there is also provided a washing machine including a rotatable drum into which laundry is put, and a controller configured to receive washing mode setting information, detect an amount of laundry put into the drum, transmit the washing mode setting information and information on the amount of laundry to a dryer, and transmit preheating request information to the dryer.

According to another aspect, there is also provided a dryer including a rotatable drum into which laundry is put, and a controller configured to receive washing mode setting information and information on an amount of laundry from a washing machine, receive preheating request information from the washing machine, and drive a compressor and a fan based on the preheating request information.

According to example embodiments, it is possible to improve operation efficiency and usability by performing an operation through interlocking between devices in a laundry treatment apparatus.

According to example embodiments, it is possible to reduce the time required for washing and drying and improve drying efficiency by providing a dryer with laundry-related information from a washing machine and performing a drying-related preparation operation based on the information received by the dryer while washing is performed.

According to example embodiments, it is possible to reduce the total time required for washing and drying and dry the laundry better by differently applying an operation method based on information on the laundry during an interlocked operation of a washing machine and a dryer.

Particular implementations of the present disclosure provide a method of controlling a washing machine. The method may include receiving setting information for a washing mode; sensing an amount of laundry received into the washing machine; transmitting, to a dryer, (i) the setting information for the washing mode and (ii) information on the amount of laundry; and transmitting, to the dryer, preheating request information.

In some implementations, the method can optionally include one or more of the following features. The preheating request information is configured to cause the dryer to preheat at a configured temperature. Receiving setting information for the washing mode may include receiving, using an input device of the washing machine, a remote control input for setting remote control of the washing machine; and receiving, via a remote terminal and based on the remote control input, the setting information for the washing mode, wherein the remote terminal is configured to communicate with the washing machine. The setting information for the washing mode may include information on a first operation mode of the washing machine. The first operation mode may be based on the amount of laundry received into the washing machine. Receiving setting information for a washing mode may include receiving, using an input device of the washing machine, the setting information for the washing mode that includes (i) information on a second operation mode of the washing machine and (ii) drying preparation setting information. Transmitting (i) the setting information for the washing mode and (ii) the information on the amount of laundry may include transmitting, to the dryer and based on the drying preparation setting information, (i) the setting information for the washing mode and (ii) information on the amount of laundry. The second operation mode of the washing machine may include a small amount rapid washing mode. The method may include performing, at the washing machine, a dehydration stroke on the received laundry; and transmitting, from the washing machine to the dryer and during the dehydration stroke, preheating stop request information. The setting information for the washing mode and the information on the amount of laundry may be configured to cause the dryer to set a drying time.

Particular implementations of the present disclosure provide a method of controlling a dryer. The method may include receiving, from a washing machine, (i) setting information for a washing mode and (ii) information on a laundry amount; receiving, from the washing machine, preheating request information; and driving the dryer based on the preheating request information.

In some implementations, the method can optionally include one or more of the following features. The dryer may include a compressor and a fan. Driving the dryer may include driving the compressor and the fan based on the preheating request information. The method may include displaying, at the dryer, estimated drying time information based on (i) the setting information for the washing mode and (ii) the information on the laundry amount. The method may include performing, based on the information on the laundry amount falling within a range of reference laundry amount value, drying operation at the dryer for a period of time. The period of time may be determined based on an ambient temperature. The range of reference laundry amount value may correspond to the setting information for the washing mode. The method may include performing, based on the information on the laundry amount not falling within the range of reference laundry amount value, drying operation at the dryer based on a dryness of laundry. The method may include determining, based on the setting information for the washing mode being input from the washing machine, a first reference laundry amount value. The first reference laundry amount value may be greater than a second reference laundry amount value that is determined based on the setting information for the washing mode being input from a user terminal. The method may include receiving, at the dryer from the washing machine, preheating stop request information; and suspending operation of at least part of the dryer based on the preheating stop request information. The dryer may include a compressor and a fan. Suspending operation may include suspending driving of at least one of the compressor and the fan.

Particular implementations of the present disclosure provide a washing machine that includes a rotatable drum configured to receive laundry, and a controller configured to perform operations including receiving setting information for a washing mode, detecting an amount of laundry received into the drum, transmitting, to a dryer, (i) the setting information for washing mode and (ii) information on the amount of laundry, and transmitting, to the dryer, preheating request information.

Particular implementations of the present disclosure provide a dryer that includes a rotatable drum configured to receive laundry, a compressor, a fan, and a controller configured to perform operations including receiving, from a washing machine, (i) setting information for a washing mode and (ii) information on an amount of laundry, receiving, from the washing machine, preheating request information, and driving the compressor and the fan based on the preheating request information.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION

Figure 1:
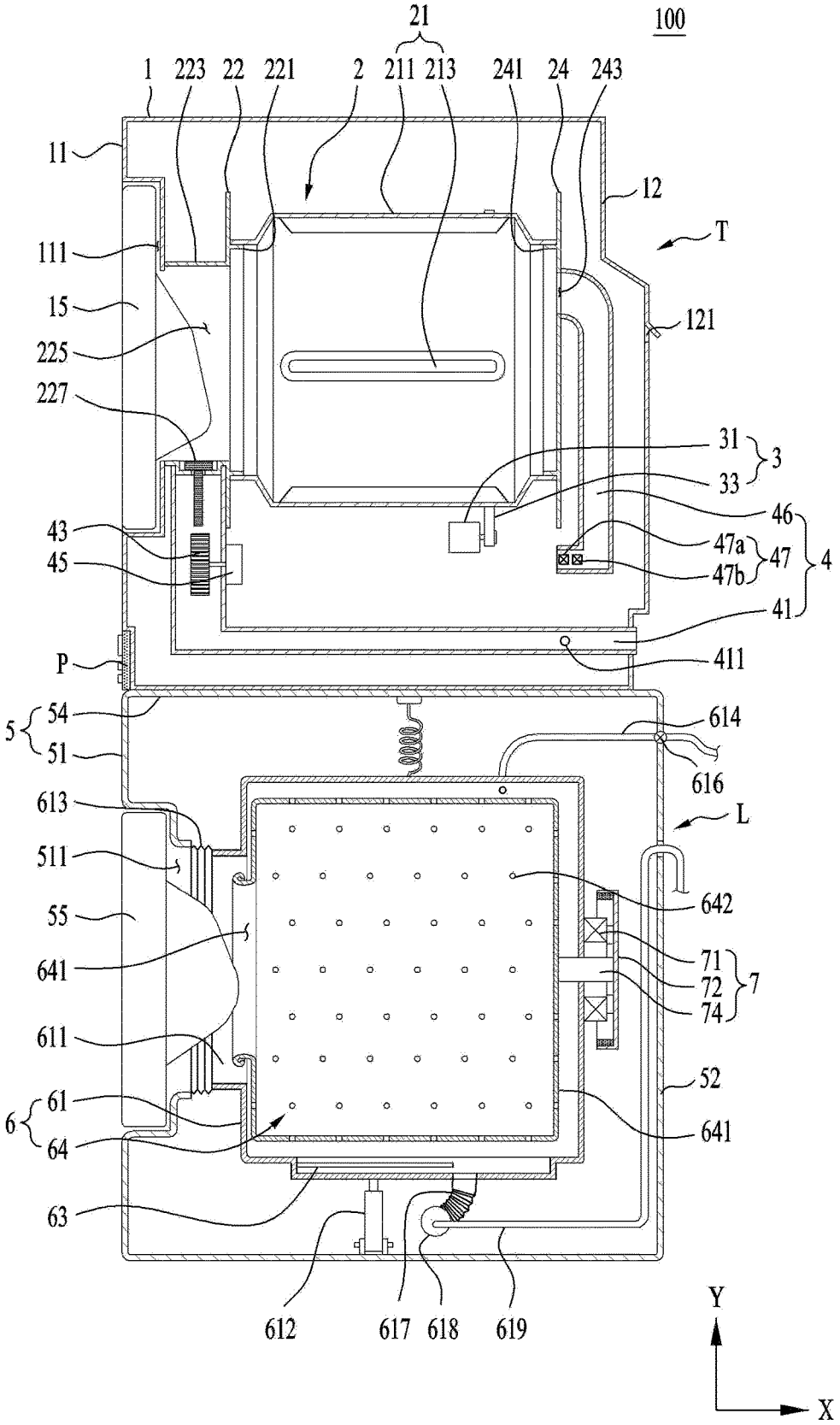
FIG. 1 illustrates an example of a laundry treatment apparatus.

Exemplary embodiments of the present disclosure are described in detail with reference to the accompanying drawings.

Detailed descriptions of technical specifications well-known in the art and unrelated directly to the present disclosure may be omitted to avoid obscuring the subject matter of the present disclosure. This aims to omit unnecessary description so as to make clear the subject matter of the present disclosure.

For the same reason, some elements are exaggerated, omitted, or simplified in the drawings and, in practice, the elements may have sizes and/or shapes different from those shown in the drawings. Throughout the drawings, the same or equivalent parts are indicated by the same reference numbers.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present disclosure will only be defined by the appended claims. Like reference numerals refer to like elements throughout the specification.

It will be understood that each block of the flowcharts and/or block diagrams, and combinations of blocks in the flowcharts and/or block diagrams, can be implemented by computer program instructions. These computer program instructions may be provided to a processor of a general-purpose computer, special purpose computer, or other programmable data processing apparatus, such that the instructions which are executed via the processor of the computer or other programmable data processing apparatus create means for implementing the functions/acts specified in the flowcharts and/or block diagrams. These computer program instructions may also be stored in a non-transitory computer-readable memory that can direct a computer or other programmable data processing apparatus to function in a particular manner, such that the instructions stored in the non-transitory computer-readable memory produce articles of manufacture embedding instruction means which implement the function/act specified in the flowcharts and/or block diagrams. The computer program instructions may also be loaded onto a computer or other programmable data processing apparatus to cause a series of operational steps to be performed on the computer or other programmable apparatus to produce a computer implemented process such that the instructions which are executed on the computer or other programmable apparatus provide steps for implementing the functions/acts specified in the flowcharts and/or block diagrams.

Furthermore, the respective block diagrams may illustrate parts of modules, segments, or codes including at least one or more executable instructions for performing specific logic function(s). Moreover, it should be noted that the functions of the blocks may be performed in a different order in several modifications. For example, two successive blocks may be performed substantially at the same time, or may be performed in reverse order according to their functions.

According to various embodiments of the present disclosure, the term "module", means, but is not limited to, a software or hardware component, such as a Field Programmable Gate Array (FPGA) or Application Specific Integrated Circuit (ASIC), which performs certain tasks. A module may advantageously be configured to reside on the addressable storage medium and be configured to be executed on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. In addition, the components and modules may be implemented such that they execute one or more CPUs in a device or a secure multimedia card.

As shown in FIG. 1, a laundry treatment apparatus 100 may include a dryer T (e.g., first treatment device) for drying clothes, and a washing machine L (e.g., second treatment device) provided to support a bottom surface of the dryer and capable of washing or drying clothes. Unlike as shown in FIG. 1, the laundry treatment apparatus 100 may be provided such that the dryer T supports a bottom surface of the washing machine L. In an example embodiment, a dryer and a washing machine are described as processing clothes, but are not limited thereto. The washing machine may wash laundry, and the dryer may dry laundry containing moisture.

The dryer T includes a first cabinet 1, a drying drum 2 rotatably provided inside the first cabinet to provide a space for storing clothes, and a supplier 4 to supply heated air into the drying drum 2.

The first cabinet 1 may include a front panel 11 (e.g., first front panel) forming a front surface of the dryer, a rear panel 12 (e.g., first rear panel) forming a rear surface of the dryer, an upper panel forming an upper surface of the dryer, and a base panel seated on an upper surface of the washing machine L.

The first front panel 11 is provided with a first inlet 111 provided to communicate with the drying drum 2, and the first inlet 111 may be provided to be opened and closed by a door 15 (first door) rotatably coupled to the first cabinet.

The drying drum 2 may be provided with a cylindrical drum body 21 with open front and rear surfaces, respectively. In this case, inside the first cabinet 1, a front support 22 rotatably supporting the front surface of the drum body 21, and a rear support 24 rotatably supporting the rear surface of the drum body 21 may be provided.

The front support 22 may include a first fixed body fixed inside the first cabinet 1, a drying drum inlet 225 provided to penetrate the first fixed body to communicate the first inlet 111 with the inside of the drum body 21, and a first support body 221 provided in the first fixed body and inserted into the front surface of the drum body 21.

The first fixed body may be provided in any shape as long as the drying drum inlet 225 and the first support body 221 may be provided. The first support body 221 may be provided in a shape of a pipe protruding from the first fixed body toward the drum body 21.

The front support 22 may be provided to be connected to the first inlet 111 through a connecting body 223. The connecting body 223 may be provided in a cylindrical shape surrounding the first inlet 111. In this case, the drying drum inlet 225 may be provided as a through-hole passing through the connecting body 223 and connected to the first inlet 111.

The connecting body 223 may be provided with an outlet communicating with the supplier 4. The outlet may be provided as a hole provided to pass through the connection body 223, and a filter 227 may be detachably inserted into the outlet. The air inside the drum body 21 may be moved to the supplier 4 through the outlet and the filter 227, and in this process, foreign matters contained in the air may be filtered out by the filter 227.

The rear support 24 may include a second fixed body fixed inside the first cabinet 1 and a second support body 241 provided in the second fixed body and inserted into the rear surface of the drum body 21. The rear support 24 is provided with a supply port 243 that is provided to pass through the second fixed body and guides the air supplied from the supplier 4 to the drum body 21.

A lifter 213 for stirring clothes may be provided on a circumferential surface of the drum body 21. The lifter 213 may be provided as a board protruding from the circumferential surface of the drum body 21 toward the center of rotation of the drum body.

The drum body 21 is rotated by a drying drum driver 3, and the drying drum driver 3 may include a drying drum motor 31 fixed in the first cabinet 1, a pulley rotated by the drying drum motor, and a belt 33 connecting a circumferential surface of the pulley and the circumferential surface of the drum body 21.

The supplier 4 may include ducts 41 and 46 and a heat exchanger 47 provided in the duct to exchange heat with air. The duct may include a discharge duct 41 for guiding the air discharged from the drying drum 2 through the outlet to the outside of the first cabinet 1, and a supply duct 46 for supplying air to the inside of the drying drum 2 through the supply port 243.

Fans 43 and 45 may be provided in the discharge duct 41, and the heat exchanger 47 may be provided in the supply duct 46. The heat exchanger 47 may include a heater that heats air introduced into the supply duct 46, and FIG. 1 shows a heater having a first heater 47*a* and a second heater 47*b* controllable independently from each other as an example. The fan may include an impeller 43 rotatably provided inside the discharge duct 41 and a fan motor 45 that rotates the impeller when power is supplied. A temperature sensor 411 for measuring the temperature of air discharged from the drying drum 2 may be provided in the discharge duct 41.

One end of the supply duct 46 may be connected to the supply port 243, and a free end thereof may be provided as a flow path located inside the first cabinet 1. When the free end of the supply duct 46 is located inside the first cabinet 1, a through-hole 121 may be provided in the first rear panel 12.

The washing machine L may include a second cabinet 5 provided to support the bottom surface of the first cabinet 1, and a second accommodating part 6 provided in the second cabinet to provide a space for storing clothes.

The second cabinet 5 may include a front panel 51 (e.g., second front panel) forming a front surface of the washing machine L, a rear panel 52 (e.g., second rear panel) forming a rear surface of the washing machine, and an upper panel 54 (e.g., second upper panel) that forms an upper surface of the washing machine and provides a space for supporting the bottom surface of the first cabinet 1.

The second front panel 51 is provided with an inlet 511 (e.g., second inlet), and the second inlet 511 may be provided to be opened and closed by a door 55 (e.g., second door). The second accommodating part 6 may include a tub 61 provided in the second cabinet 5 to provide a space for storing water, and a washing drum 64 rotatably provided in the tub to store clothes.

The tub 61 may be fixed to the second cabinet 5 through the tub support 612. A tub inlet 611 communicating with the second inlet 511 is provided on the front surface of the tub 61, and the tub inlet 611 may be connected to the second inlet 511 through a gasket 613.

The tub 61 is supplied with water through a water supplier, and water stored in the tub 61 is discharged to the outside of the second cabinet 5 through a drainage.

The water supplier may include a water supply pipe 614 connecting the water supply source and the tub 61 and a water supply valve 616 controlling opening and closing of the water supply pipe. The drain may include a first drain pipe 617 guiding the water inside the tub 61 to a drain pump 618, and a second drain pipe 619 guiding the water discharged from the drain pump 618 to the outside of the second cabinet 5. The tub 61 may be provided with a heater 63 for heating the water supplied through the water supplier.

The washing drum 64 may be provided in a cylindrical shape with its inside empty. A washing drum inlet 641 communicating with the second inlet 511 through the tub inlet 611 is provided on a front surface of the washing drum. A drum through-hole 642 for communicating the inside of the washing drum with the inside of the tub may be provided on a circumferential surface and a rear surface of the washing drum.

The washing drum 64 may be rotated by the washing drum driver 7 (washing drum motor). The washing drum driver 7 may include a stator 71 fixed to a rear surface of the tub 61 to form a rotating magnetic field, a rotor 72 rotating by the rotating magnetic field, and a rotation shaft 74 connecting the rotor 72 and the rear surface of the washing drum 64 through the rear surface of the tub.

Figure 2:
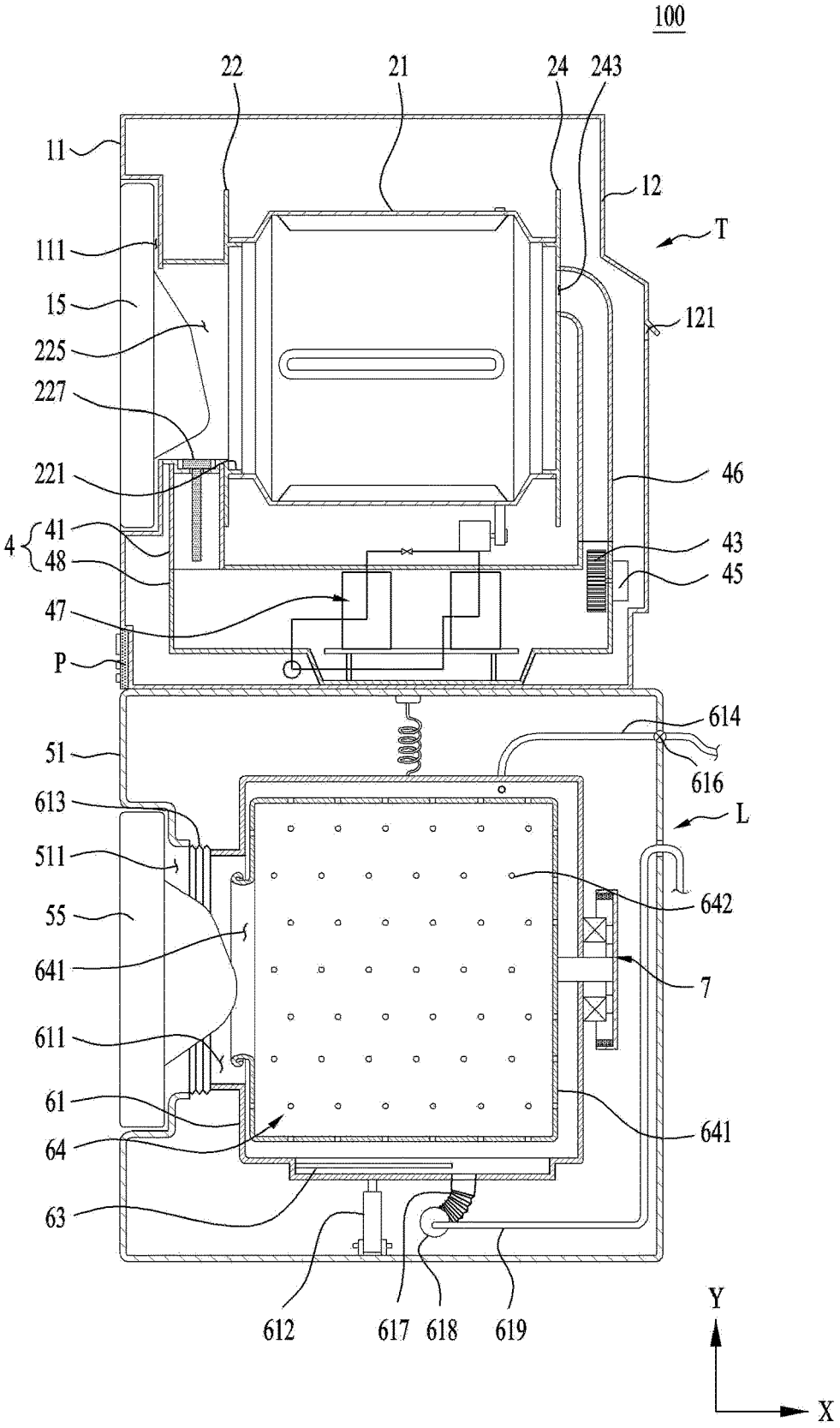
FIGS. 2 and 3 illustrate another example of a laundry treatment apparatus.

FIG. 2 illustrates another example of the laundry treatment apparatus 100. The laundry treatment apparatus according to the present embodiment is also provided to include a dryer T and a washing machine L. The laundry treatment apparatus provided in this example embodiment may have a structure corresponding to the laundry treatment apparatus shown in FIG. 1 except for the structure of a supplier 4 provided in the dryer.

The supplier 4 according to the present embodiment may include ducts 41, 46, and 48 forming a flow path for resupplying the air discharged from the drum body 21 to the drum body 21, and a heat exchanger 47 for dehumidifying and heating the air introduced into the duct.

The duct may include a discharge duct 41 connected to the outlet 226, a supply duct 46 connected to the supply port 243, and a connecting duct 48 connecting the discharge duct and the supply duct. In this case, an impeller 43 of a fan may be provided to be located inside the connecting duct 48.

Figure 3:
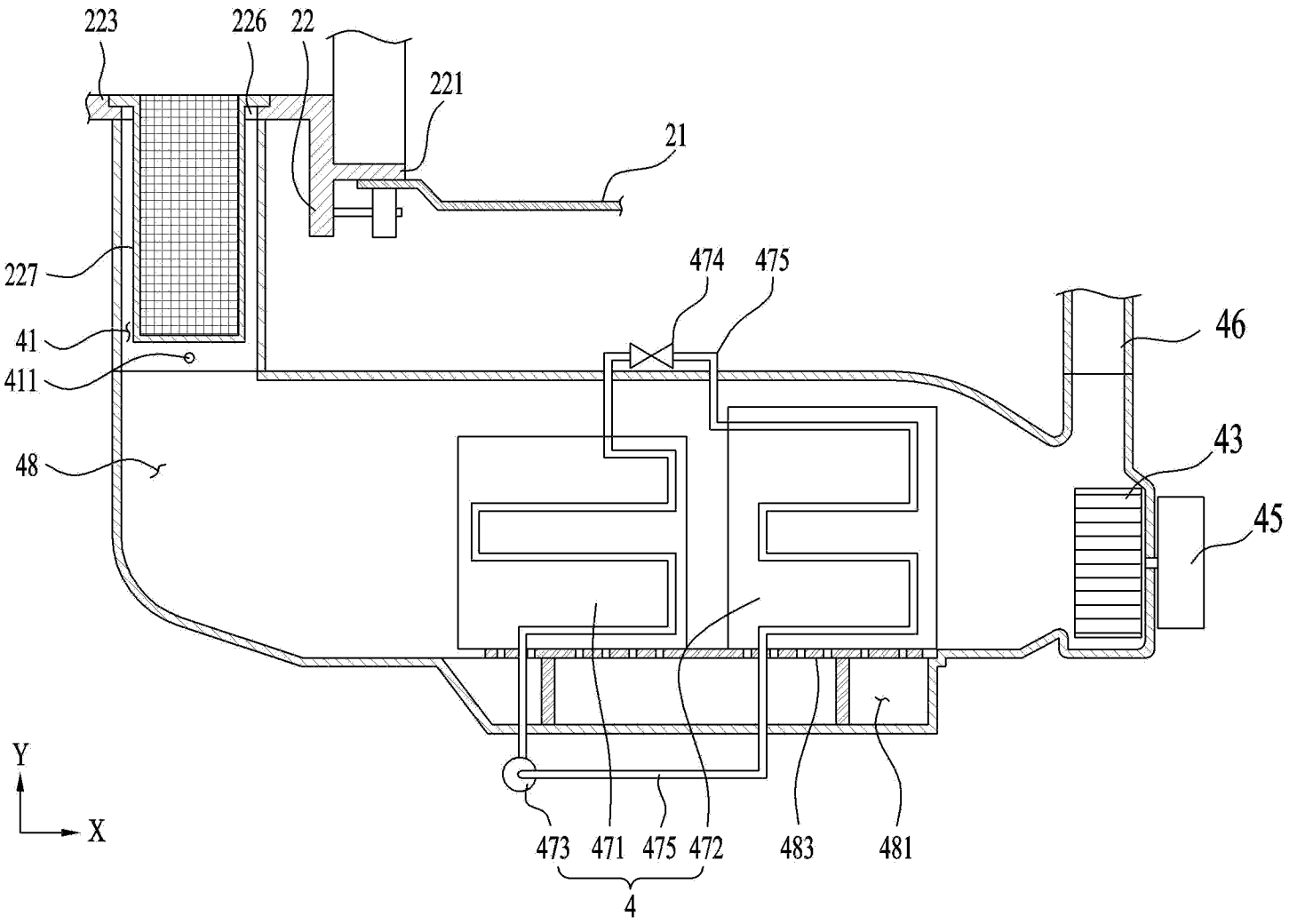

As shown in FIG. 3, the heat exchanger 47 includes a first heat exchanger 471 (e.g., heat absorber) that removes moisture from the air introduced into the connecting duct 48 and a second heat exchanger 472 (e.g., heat emitter) provided in the connecting duct 48 for heating the air passed through the heat absorber 471. The heat absorber 471 and the heat emitter 472 are sequentially arranged along the moving direction of air, and are connected to each other through a refrigerant pipe 475 forming a circulation passage for the refrigerant.

The refrigerant moves along the refrigerant pipe 475 by a compressor 473 located outside the ducts 41, 46, 48, and a pressure regulator 474 for adjusting the pressure of the refrigerant passed through the heat emitter 472 is provided in the refrigerant pipe 475.

The heat absorber 471 is an element for cooling the air and evaporating the refrigerant by transferring heat of the air introduced into the discharge duct 41 to the refrigerant. The heat emitter 472 is an element for heating the air and condensing the refrigerant by transferring heat of the refrigerant that has passed through the compressor 473 to the air. In this case, moisture contained in the air may be collected on a bottom surface of the connecting duct 48 along a surface of the heat absorber 471 when passing through the heat absorber 471.

In order to collect water removed from the air passing through the heat absorber 471, a water collecting body 481 is provided in the dryer T. The water collecting body 481 may be provided anywhere inside the laundry treatment apparatus so as to store water discharged from the heat absorber. FIG. 3 shows an example in which the water collecting body 481 is provided to communicate with the bottom surface of the connecting duct 48.

A heat exchanger support 483 may be further provided inside the water collecting body 481 so that the heat absorber 471 and the heat emitter 472 do not contact the water (for example, condensed water) stored in the water collecting body 481.

Figure 4:
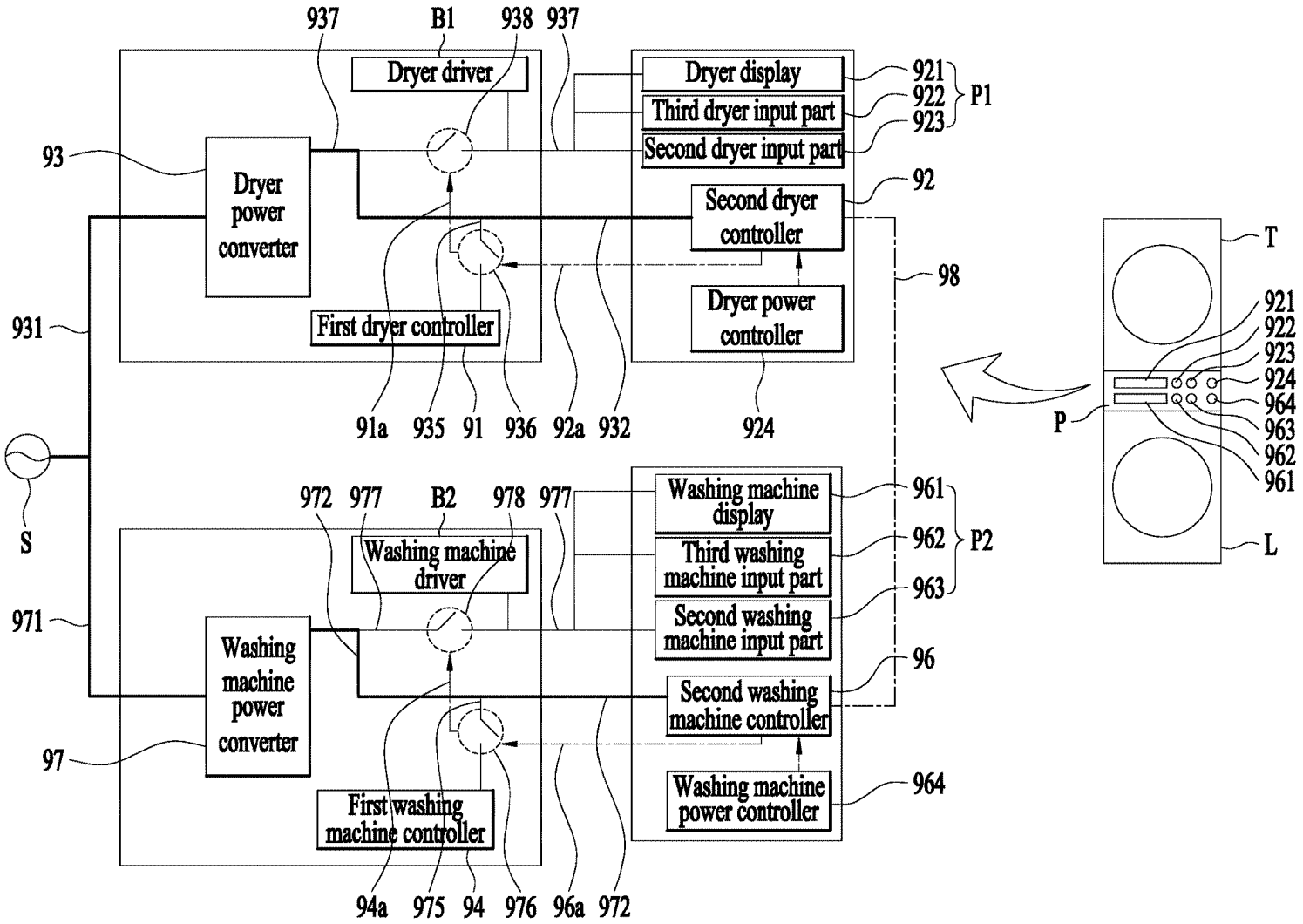
FIG. 4 illustrates an example of a control panel, a washing machine driver, a dryer driver, a washing machine interface, and a dryer interface provided in a laundry treatment apparatus.

The above-described laundry treatment apparatus 100 requires an input part and a display part necessary for controlling the respective devices T and L. That is, as shown in FIG. 4, a dryer interface P1 is provided in the dryer T, and a washing machine interface P2 is provided in the washing machine L.

The dryer interface P1 is provided to include a dryer display 921 and dryer input parts 922 and 923, and the washing machine interface P2 may include a washing machine display 961 and washing machine input parts 962 and 963.

The dryer display 921 is an element for displaying a control command that may be input to the dryer T or a control command that has been input to the dryer T, and the dryer input parts 922 and 923 are elements for inputting a control command to the dryer T. Likewise, the washing machine display 961 is an element for displaying a control command that may be input to the washing machine L or a control command that has been input to the washing machine L, and the washing machine input parts 962 and 963 are elements for inputting a control command to the washing machine L.

In order to form a sense of design unity of the laundry treatment apparatus 100 in which the two treatment devices are arranged vertically, the dryer display 921, the dryer input parts 922 and 923, the washing machine display 961, and the washing machine input parts 962 and 963 may be provided on one control panel P.

The control panel P may be provided such that an upper surface thereof is fixed to the front surface (e.g., first front panel) of the dryer, and a lower surface thereof is fixed to the front surface (e.g., second front panel) of the washing machine. In this case, the control panel P may also serve as a fastening part for fixing the dryer T to the washing machine L (for example, a role of fastening the first front panel and the second front panel).

Unlike the above, the control panel P may be provided to be fixed to one of the first front panel 11 and the second front panel 51. FIGS. 1 and 3 illustrate an example in which the control panel P is fixed to a lower end of the first front panel 11. That is, a panel receiving groove formed by concave bending of the surface of the first front panel is provided at the lower end of the first front panel 11, and the control panel P may be fixed in the panel receiving groove. In this case, the control panel P may form the front surface of the dryer together with the first front panel 11.

The dryer display 921 and the dryer input parts 922 and 923 are controlled by a second dryer controller 92 provided in the dryer, and the washing machine display 961 and the washing machine input parts 962 and 963 are controlled by the second washing machine controller 96 provided in the washing machine. The meaning of the second controller controlling the display and the input part is that the second controller and each device are provided to exchange control signals (or provided to communicate) with each other. The second dryer controller 92 and the second washing machine controller 96 may be provided to communicate with each other through a communication circuit 98.

The dryer input parts may include a first dryer input part 922 and a second dryer input part 923. The first dryer input part 922 is an element for allowing to select one of executable control commands (drying courses) of the dryer, and the second dryer input part 923 may be provided as an element for inputting a control command requesting an execution of the selected control command or a temporary suspension of the command being executed.

The washing machine input parts may also include a first washing machine input part 962 and a second washing machine input part 963. The first washing machine input part 962 is an element for allowing to select one of executable control commands (washing courses) of the washing machine, and the second washing machine input part 963 may be provided as an element for inputting a control command requesting an execution of the selected control command or a temporary suspension of the command being executed.

The load of the dryer is divided into a drive load and an interface load, and the drive load (e.g., dryer drive load) is a dryer driver B1, composed of a drying drum motor 31, a fan motor 45, a heat exchanger 47, and a temperature sensor 411, and the interface load (e.g., dryer interface load) is the dryer interface P1 composed of the dryer display 921 and dryer input parts 922 and 923.

Power of the dryer loads B1 and P1 may be provided to be controlled by the first dryer controller 91. However, the operation of the dryer driver B1 may be controlled by the first dryer controller 91, and the operation of the dryer interface P1 may be controlled by the second dryer controller 92.

The dryer T is connected to the power source S through a first power line 931, and the AC power supplied to the first power line 931 may be provided to be converted to DC power through the first converter 93. In this case, the second dryer controller 92 receives power through the first dryer power circuit 932 connected to the first converter 93, and the first dryer controller 91 receives power through the second dryer power circuit 935, and the dryer driver B1 and the dryer interface P1 may be provided to receive power through the third dryer power circuit 937.

The second dryer power circuit 935 may be provided with a first dryer switch 936, and the third dryer power circuit 937 may be provided with a second dryer switch 938. The first dryer switch 936 may be provided to open or close the second dryer power circuit 935 according to a control signal from the second dryer controller 92 or a control signal from a dryer power controller 924. The dryer power controller 924 may be provided in the control panel P and may be provided as an element for controlling power supply to the dryer driver B1 and the dryer interface P1.

When the dryer power controller 924 transmits a control signal requesting power supply to the second dryer controller 92 (for example, when a user inputs a power supply request signal through the dryer power controller), the second dryer controller 92 controls the first dryer switch 936 so that the second dryer power circuit 935 is closed through the first dryer switch control circuit 92*a*. When the first dryer switch 936 closes the second dryer power circuit 935, the first dryer controller 91 may be supplied with power.

Meanwhile, the second dryer switch 938 may be provided to open and close the third dryer power circuit 937 according to a control signal transmitted from the first dryer controller 91 through the second dryer switch control circuit 91*a*. Alternatively, it may be provided to open and close the third dryer power circuit 937 according to a control signal transmitted from the second dryer controller 92. The dryer driver B1 and the dryer interface P1 may be supplied with power when the second dryer switch 938 closes the third dryer power circuit 937.

The second dryer controller 92 and the dryer power controller 924 are maintained as being connected to a power source through the first dryer power circuit 932. However, the dryer driver B1 and the dryer interface P1 may be supplied with power when a user inputs a control command to the dryer power controller 924 or when the second dryer controller 92 receives a control signal from the second washing machine controller 96.

The dryer T having the above-described structure supplies power only to the second dryer controller 92 and the dryer power controller 924 when the dryer driver B1 and the interface P1 are not operating. Accordingly, the consumption of standby power may be minimized.

The load of the washing machine L is divided into a drive load and an interface load. The washing machine drive load is a washing machine driver B1, composed of a washing drum driver 7, a water supply valve 616, a drain pump 618, and a heater 63, and the washing machine interface load is the washing machine interface P2 composed of the washing machine display 961 and washing machine input parts 962 and 963.

Power of the washing machine loads B2 and P2 may be provided to be controlled by the first washing machine controller 94. The operation of the washing machine driver B2 may be controlled by the first washing machine controller 94, and the operation of the washing machine interface P2 may be controlled by the second washing machine controller 96.

The washing machine L is connected to the power source S through a second power line 971, and the AC power supplied to the second power line 971 may be provided to be converted to DC power through the second converter 97. As the power line 931 of the dryer T and the power line 971 of the washing machine L are separated and independently provided, even if one of the two power lines is damaged or one of the two devices failed, the other device may operate normally.

The second washing machine controller 96 receives power through the first washing machine power circuit 972 connected to the second converter 97, the first washing machine controller 94 receives power through the second washing machine power circuit 975, and the loads B2 and P2 of the washing machine may be provided to receive power through the third washing machine power circuit 977.

The second washing machine power circuit 975 is provided with a first washing machine switch 976, and the first washing machine switch 936 may be provided to open or close the second washing machine power circuit 975 according to a control signal from the second washing machine controller 96 or a control signal from a washing machine power controller 964. The washing machine power controller 964 may be provided in the control panel P and may be provided as an element for controlling power supply to the washing machine driver B2 and the washing machine interface P2.

When the washing machine power controller 964 transmits a control signal requesting power supply to the second washing machine controller 96 (for example, when a user inputs a power supply request signal through the washing machine power controller), the second washing machine controller 96 controls the first washing machine switch 976 so that the second washing machine power circuit 975 is closed through the first washing machine switch control circuit 96*a*. When the first washing machine switch 976 closes the second washing machine power circuit 975, the first washing machine controller 94 may be supplied with power.

Meanwhile, the second washing machine switch 978 may be provided to open and close the third washing machine power circuit 977 according to a control signal transmitted from the first washing machine controller 94 through the second washing machine switch control circuit 94*a*. Alternatively, it may be provided to open and close the third washing machine power circuit 977 according to a control signal transmitted from the second washing machine controller 96. The washing machine driver B2 and the interface P2 may be supplied with power when the second washing machine switch 978 closes the third washing machine power circuit 977.

The second washing machine controller 96 and the washing machine power controller 964 are always connected to a power source through the first washing machine power circuit 972. However, the washing machine driver B2 and the washing machine interface P2 may be supplied with power when a user inputs a control command to the washing machine power controller 964 or when the second washing machine controller 96 receives a control signal from the first dryer controller 92.

Meanwhile, although the configuration of each controller has been separately described in the example embodiment, the configuration of each controller is not limited thereto. The washing machine controller may control overall operation of the washing machine, the dryer controller may control overall operation of the dryer. Each controller may communicate with another controller, and each device may be controlled based on information acquired through communication. In an example embodiment, communication may be performed through at least one of wired and wireless.

Figure 5:
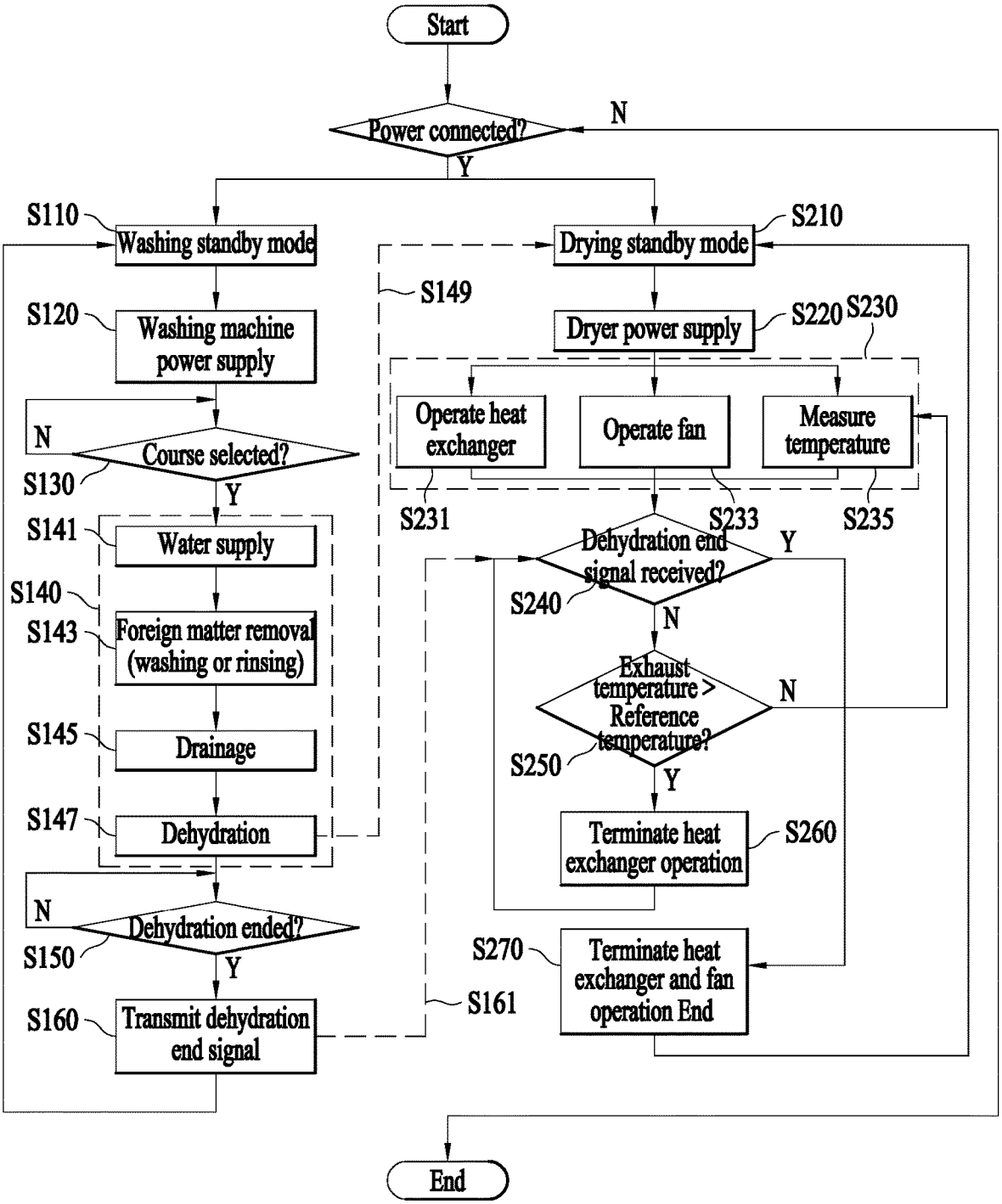
FIG. 5 illustrates an example of a control method of a laundry treatment apparatus.

FIG. 5 shows an example of a control method of the laundry treatment apparatus 100.

As shown in the figure, when the first power line 931 and the second power line 971 are connected to the power source S, respectively, the laundry treatment apparatus 100 performs washing standby mode operation S110 and drying standby mode operation S210.

In washing standby mode operation S110, the washing machine driver B2, the washing machine interface P2, and the first washing machine controller 94 are not provided with power, but the second washing machine controller 96 and the washing machine power controller 964 are provided with power. That is, the first washing machine switch 976 maintains the second washing machine power circuit 975 open, and the second washing machine switch 978 maintains the third washing machine power circuit 977 open, in washing standby mode operation S110.

The washing machine power controller 964 may be provided as a switch for operating the first washing machine switch 976 without maintaining a state in which power is supplied. In this case, in washing standby mode operation S110, the washing machine driver, the washing machine interface, and the first washing machine controller are not provided with power, but the second washing machine controller is provided with power.

In drying standby mode operation S210, the dryer driver B1, the dryer interface P1, and the first dryer controller 91 are not provided with power, but the second dryer controller 92 and the dryer power controller 924 are provided with power. That is, the first dryer switch 936 maintains the second dryer power circuit 935 open, and the second dryer switch 938 maintains the third dryer power circuit 977 open, in drying standby mode operation S210.

The dryer power controller 924 may be provided as a switch capable of operating the first dryer switch 976 without maintaining a state in which power is supplied. In this case, in drying standby mode operation S210, the dryer driver, the dryer interface, and the first dryer controller are not provided with power, but the second dryer controller is provided with power. In the example embodiment, the dryer may receive information through communication with the washing machine in drying standby mode operation S210.

When a control signal for requesting power supply to the washing machine load is input through the washing machine power controller 964 during washing standby mode operation S110, washing machine power supply operation S120 is performed. Washing machine power supply operation S120 may include supplying power to the first washing machine controller 94, the washing machine driver B1, and the washing machine interface P2.

When washing machine power supply operation S120 is completed, the control method determines whether a washing course is input to the washing machine interface B2 in operation S130. When a washing course selection command is input through the first washing machine input part 962 and a start command for the selected washing course is input through the second washing machine input part 963, the control method performs course execution operation S140 by controlling the washing machine driver B2.

Meanwhile, at the beginning of course execution operation S140, the washing machine may measure the amount of the object to be washed. In the example embodiment, the amount of the object to be washed may be referred to as the laundry amount, and the laundry amount may be measured by measuring a torque value related to the rotation of the drum. In addition, the washing machine may transmit information on the measured laundry amount and information on the selected course to the dryer. The dryer may perform a preheating operation and a subsequent drying operation based on the received information.

Course execution operation S140 may be provided to sequentially proceed with a water supply stroke S141, a foreign matter removal stroke S143, a drainage stroke S145, and a dehydration stroke S147.

The water supply stroke S141 may be provided as a process in which the first washing machine controller 94 controls the water supply valve 616 to supply water to the tub 61, and the foreign matter removal stroke S143 may be provided as a process in which the first washing machine controller 94 controls the washing drum driver 7 to rotate the washing drum 64. The foreign matter removal stroke S143 is a process of separating foreign matters from laundry (object to be washed), examples of which may be a washing stroke or a rinsing stroke.

The drainage stroke S145 may be provided as a process in which the first washing machine controller 94 controls the drain pump 618 to discharge water stored in the tub 61 to the outside of the second cabinet 5, and the dehydration stroke S147 may be provided as a process in which the first washing machine controller 94 controls the washing drum driver 7 to remove water from laundry. When the dehydration stroke S147 ends in operation S150 (for example, course execution operation ends), the control method resumes washing standby mode operation S110 to switch the washing machine L to the standby mode.

In order to shorten the drying time of laundry after washing, the control method includes power supply operation S220 and preheating operation S230 of increasing the temperature of the drying drum 2 and the supplier 4 during course execution operation S140.

Laundry put into the drying drum 2 does not exchange heat with air as soon as the heat exchanger 47 provided in the supplier starts operation. This is because the heat energy supplied to the drying drum 2 by the operation of the heat exchanger 47 supplies heat energy to the heat exchange passage composed of the drying drum, the duct and the heat exchanger until the temperature of the heat exchange passage becomes higher than the temperature of the laundry.

That is, the dryer sequentially performs a process of heat exchange between the heat exchange passage and air and a process of heat exchange between the laundry and air, and the time required for drying is the sum of the time required for each process.

In preheating operation S230 provided in the control method of FIG. 5, the dryer T executes a process of increasing the temperature of the heat exchange passage before the operation of the washing machine L is completed, so that the time required for drying laundry (for example, time required for washing and drying) may be shortened.

To this end, in the control method of FIG. 5, communication operation S149 (for example, first communication operation) in which the second washing machine controller 96 transmits a control signal to the second dryer controller 92 through the communication circuit 98 is performed during course execution operation S140.

When the second dryer controller 92 receives a control signal from the second washing machine controller 96, the control method proceeds to dryer power supply operation S220 of supplying power to the dryer driver B1. In dryer power supply operation S220, the second dryer controller 92 controls the first dryer switch control circuit 92*a* to supply power to the first dryer controller 91, and the first dryer controller 91 controls the second dryer switch control circuit 91*a* to supply power to the dryer driver B1.

In dryer power supply operation S220, the dryer interface P1 may be provided so as not to receive power. In this case, the third dryer power circuit 937 should further include a third dryer switch (not shown) that controls power supplied to the dryer interface P1. The third dryer switch is located between the second dryer switch 938 and the dryer display P1, and is provided as a switch controlled by either the first dryer controller 91 or the second dryer controller 92.

Preheating operation S230 may include a supply stroke S233 in which the first dryer controller 91 operates the fans 43 and 45 to supply air to the drying drum 2 and a heating stroke S231 in which the first dryer controller 91 operates the heat exchanger 47 to heat the air supplied to the drying drum 2.

As the duration of preheating operation S230 increases, the amount of power consumed by the dryer T may increase. Accordingly, first communication operation S149 may be set to be performed between the time when the drainage stroke S145 is completed and the time when the dehydration stroke S150 is completed. FIG. 5 shows an example in which the time point of first communication operation S149 is set as a time point between the start time point S147 of the dehydration stroke and the end time point S150 of the dehydration stroke.

Preheating operation S230 described above may be set to end in response to the end S150 of the dehydration stroke. To this end, the control method may include communication operation S161 (second communication operation) in which the second washing machine controller 96 notifies the second dryer controller 92 of the end of the dehydration stroke after the dehydration stroke ends. By terminating preheating operation S230 as described above, excessive energy consumption may be prevented. Also, when the user moves the washed laundry to the dryer, it is possible to prevent inconvenience due to excessive heat.

When the end of course execution operation S140 is notified in operation S240 through second communication operation S161, the second dryer controller 92 notifies the first dryer controller 91, and the first dryer controller 91 may terminate the operation of the heat exchanger 47 and the fan motor 45 in operation S270. When preheating operation is terminated in operation S270, the control method resumes drying standby mode operation S210 to switch the dryer T to the standby mode.

Preheating operation S230 that is performed until the start of second communication operation S161 may be provided to control the heat exchanger 47 according to the temperature of the heat exchange passage. The temperature of the heat exchange passage may be determined through at least one of a temperature of air discharged from the drying drum 2 and a temperature of a refrigerant circulating along the refrigerant pipe 475.

That is, the laundry treatment apparatus 100 having the structure of FIGS. 1 to 3 may determine the preheating state of the heat exchange passage by measuring the temperature of the air flowing into the discharge duct 41 using the temperature sensor 411. However, the laundry treatment apparatus having the structure of FIGS. 2 and 3 may determine the preheating state of the heat exchange passage by measuring the temperature of the refrigerant or the temperature of the refrigerant pipe 475.

During preheating operation S230, the control method may perform measuring operation S235 of measuring the temperature of the air discharged from the drying drum 2 using the temperature sensor 411. Measuring operation S235 may be periodically repeated after the start of preheating operation S230 and may be set to be terminated at the end of preheating operation S230.

When second communication operation S161 is not started, and when it is determined in operation S250 that the temperature measured in measuring operation S235 is lower than a preset reference temperature, the control method maintains preheating operation S230.

In contrast, when second communication operation S161 is not started, and when it is determined in operation S250 that the temperature measured in measuring operation S235 is higher than the reference temperature, the control method suspends the heating stroke S231 in operation S260. That is, when it is determined in operation S250 that the temperature of the air introduced into the exhaust duct 41 is higher than the reference temperature, preheating operation S230 maintains the supplying stroke S233, but the heating stroke S231 is temporarily suspended.

After the heating stroke is suspended in operation S260, the control method resumes operation S240 of determining whether the second washing machine controller 96 has transmitted a dehydration end signal to the second dryer controller 92.

On the other hand, even if preheating operation S230 only proceeds with the supplying stroke S233, measuring operation S235 is performed periodically, and the heating stroke S231 resumes when the air temperature measured while only the supplying stroke S233 is in progress is below the reference temperature.

Considering that heat exchange between the laundry put into the drying drum 2 and the air becomes active when the temperature of the air discharged from the drying drum 2 is approximately 65 degrees Celsius, the reference temperature may be set between 55 degrees Celsius and 75 degrees Celsius.

Figure 6:
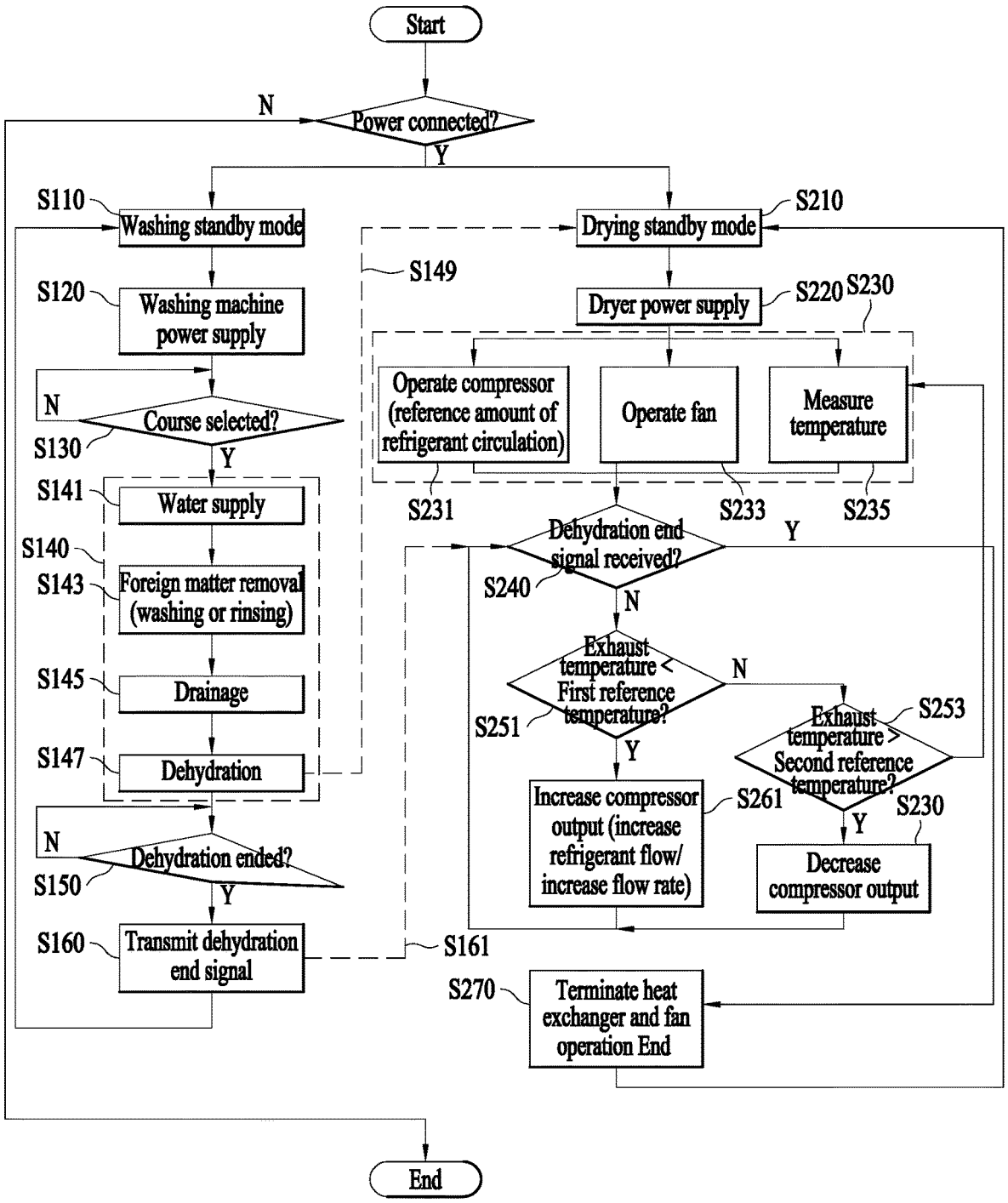
FIG. 6 illustrates another example of a control method of a laundry treatment apparatus.

FIG. 6 shows another example of a control method of the laundry treatment apparatus having the structures of FIGS. 2 and 3. A difference in this example embodiment from the control method of FIG. 5 is that the output of the compressor 473 is regulated according to the temperature of the heat exchange passage.

That is, the control method according to the present example embodiment proceeds to operation S251 of determining whether the temperature measured in measurement operation S235 is less than a first preset reference temperature. When the temperature measured by the temperature sensor 411 is less than the first reference temperature, in operation S261, the first dryer controller 91 increases the output of the compressor 473 to increase the flow rate of the refrigerant. This is to increase the temperature of the heat exchange passage in a short time.

If the compressor 473 has a structure that moves the refrigerant using centrifugal force such as an impeller, the output of the compressor may be increased by increasing the number of rotations of the impeller. If the compressor 473 compresses the refrigerant using a linear reciprocating piston, the output of the compressor may be increased by shortening the reciprocating cycle of the piston.

On the other hand, if the temperature measured in measuring operation S235 is equal to or higher than the first reference temperature, the control method proceeds to operation S253 of determining whether the temperature of the air discharged from the drying drum 2 is higher than a second reference temperature (a temperature higher than the first reference temperature).

When the temperature of the air introduced into the discharge duct 41 is higher than the second reference temperature, in operation S263, the first dryer controller 91 controls the compressor to decrease the flow rate of the refrigerant.

However, if the temperature measured in measuring operation S235 is equal to or greater than the first reference temperature and less than the second reference temperature, the control method maintains the heating stroke S231 and the supply stroke S233 (while maintaining refrigerant flow rate), and periodically determines whether a dehydration end signal has been transmitted in operation S240.

Considering that heat exchange between the laundry put into the drying drum 2 and the air becomes active when the temperature of the air discharged from the drying drum 2 is approximately 65 degrees Celsius, the first reference temperature may be set to 55 degrees Celsius and the second reference temperature may be set to 75 degrees Celsius.

Figure 7:
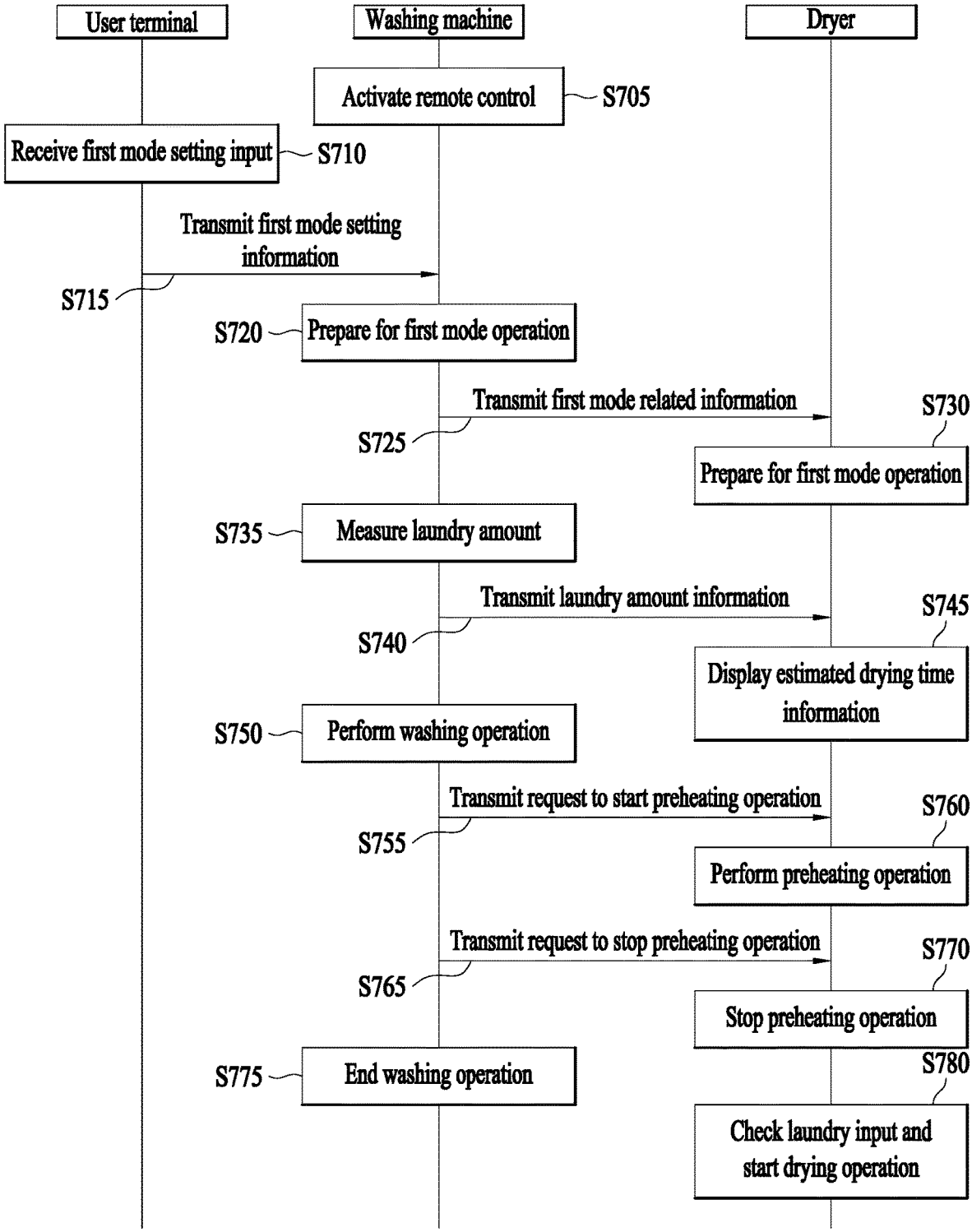
FIG. 7 is a diagram illustrating an operation method of a laundry treatment apparatus according to an example embodiment of the present disclosure.

FIG. 7 is a diagram illustrating an operation method of a laundry treatment apparatus according to an example embodiment of the present disclosure.

Referring to FIG. 7, a method of controlling an operation of a laundry treatment apparatus including a washing machine and a dryer through a user terminal is illustrated. The description is made based on a laundry treatment apparatus including a washing machine and a dryer, but it is not limited thereto, and the present example embodiment may be applied when the washing machine and the dryer may communicate with each other.

In operation S705, the washing machine may set to activate remote control. In an example embodiment, the remote control activation setting may be performed through the washing machine input part, and the washing machine operation may be controlled through communication with a terminal linked to the washing machine through such remote control activation. For example, a washing machine-related app may be driven in a user terminal linked to the washing machine, the washing machine may be controlled based on an input through the corresponding app, and additional washing machine operation settings may be facilitated by performing control through such an app. In an example embodiment, a new course may be applied by downloading course information for controlling the washing machine through the app and transmitting it to the washing machine even if course information is not directly provided to the washing machine. A washing machine in which remote control activation is set may be controlled through a terminal corresponding to the washing machine.

In operation S710, a first mode setting input may be received through the user terminal. In an example embodiment, the first mode may be a mode related to an operation of a washing machine, and as an example, it may include an input related to a mode for washing a small amount of laundry. In addition, in the example embodiment, a mode for washing a small amount of laundry may include a mode such as washing a single shirt, and when washing such a small amount of laundry, the operation of the washing machine and the dryer may be controlled to perform rapid laundry unlike normal laundry.

In operation S715, the user terminal may transmit the first mode setting information to the washing machine. In an example embodiment, information related to the first mode may be transmitted to the washing machine, and information indicating the start of an operation related to the first mode may be transmitted to the washing machine. More specifically, information on which the first mode setting input through the user terminal has performed may be transmitted to the washing machine.

In operation S720, the washing machine may prepare for a first mode operation based on the received information. For example, the display may be turned on in response to the received information, and the display may indicate that washing is performed in connection with the first mode.

In operation S725, the washing machine may transmit information related to the first mode to the dryer. As an example, the washing machine may transmit information about this while performing an operation corresponding to the first mode. For example, course identification information related to the first mode may be transmitted from the washing machine to the dryer. Meanwhile, in an example embodiment, information on the first mode setting input may be directly transmitted from the user terminal to the dryer. In this case, when a first mode setting input is obtained in the user terminal, related information may be transmitted to the washing machine and dryer in response thereto, and accordingly, the dryer may prepare for an operation corresponding to the first mode based on the received information.

In operation S730, the dryer may prepare for an operation corresponding to the first mode based on the received information. For example, the dryer may turn on the display and the display may indicate that the drying operation corresponding to the first mode operating in the washing machine is performed. As an example, when performing a washing course for a single shirt, the washing machine may transmit corresponding information to the dryer in response to the display being turned on in response to the corresponding mode, and the dryer may also indicate on the display that the drying operation is scheduled to be performed. In this way, by preparing the dryer to operate in response to the operation of the washing machine, the user may instruct a corresponding course through the user terminal and check the operation preparation state through both the washing machine and the dryer.

In operation S735, the washing machine may measure the amount of laundry. In an example embodiment, the washing machine may rotate a drum according to a specific pattern and measure the amount of laundry based on torque information according to the rotation. The amount of laundry may be a parameter considered for performing a washing process in a washing machine and a drying process in a dryer.

In operation S740, the washing machine may transmit the laundry amount information to the dryer. Meanwhile, in an example embodiment, information transmitted in operations S725 and S740 may be transmitted from the washing machine to the dryer at a time.

In operation S745, the dryer may display information on an estimated drying time for the target laundry based on the received laundry amount information. In an example embodiment, the estimated drying time may be displayed, and the dryer may turn on only some components including the display part, and wait to turn on at least some of the remaining components in response to a preheating preparation signal to be received later. The information displayed in the example embodiment may include at least one of a time required for drying, a time required for washing and drying, and time information at which drying is expected to be completed. In addition, in an example embodiment, the dryer may prepare for the preheating operation while displaying information about the estimated drying time. The dryer may perform a preheating operation for the dryer when receiving a triggering signal according to the progress of the washing process of the washing machine. Meanwhile, in the example embodiment, when the laundry amount is more than a certain amount, the dryer may perform sensing drying, and in this case, the estimated drying time may not be displayed or may be displayed as a preset value to be provided to the user, along with information that sensing drying is performed.

In operation S750, the washing machine may perform a washing operation. More specifically, at least one of water supply, washing, rinsing, drainage, and dehydration operations may be performed, and each operation may be performed at least once. The washing machine may check the remaining time according to the progress of the washing operation, and the remaining time information may be determined based on the laundry amount. In an example embodiment, the washing machine may check information necessary for preheating the dryer, which may be stored in the washing machine as preset information or acquired by the washing machine by an external signal.

In operation S755, the washing machine may transmit a request to start a preheating operation to the dryer based on the remaining time for washing. For example, the washing machine may transmit a preheating operation start request to the dryer at a timing determined based on a time required for preheating of the dryer and a remaining time of washing. In one example, information indicating when to start the preheating operation may be transmitted to the dryer.

In operation S760, the dryer may perform a preheating operation based on the received information. In an example embodiment, the dryer may operate at least one of a fan and a compressor to perform a preheating operation for performing drying. When performing such a preheating operation, hot air may circulate within the drum, and the circulated air may be heated through heat exchange with a heat exchanger of the dryer. As described in the previous example embodiment, the dryer may control a configuration that operates to maintain a temperature range suitable for preheating.

In operation S765, the washing machine may transmit a request to stop the preheating operation to the dryer in response to the progress of the washing operation. For example, when the end of the washing operation is imminent, it is expected that the user may take out the laundry from the washing machine and put it into the dryer. If the temperature in the drum is higher than necessary due to the preheating operation of the dryer or the circulation of hot air continues, inconvenience to the user may be expected.

Accordingly, the washing machine may transmit the request to stop the preheating operation to the dryer. More specifically, the washing machine may transmit the request to stop the preheating operation to the dryer during the dehydration operation. For example, the washing machine may transmit the request to stop the preheating operation to the dryer 1 minute before the end of the dehydration. In addition, information indicating that the end of the washing process is imminent may be transmitted to the user terminal. Through this, when the user is away from the washing machine, the user may receive the corresponding information through the terminal and prepare to take out the laundry from the washing machine.

In operation S770, the dryer may stop the preheating operation based on the received information. In one example, the dryer may stop operating at least one of the fan and the compressor.

In operation S775, the washing machine may complete the washing operation, and may provide an alarm for completion to the user through an output part of the washing machine or a user terminal. Through such an alarm, the user may take the laundry out of the washing machine and put it into the dryer.

In operation S780, the dryer may check the input laundry and perform a drying operation corresponding thereto. For example, a drying operation may be performed based on at least a part of information received from the washing machine. More specifically, when the laundry amount corresponding to the first mode is identified, the drying operation may be performed accordingly. In one example, a drying operation may be performed based on the laundry amount information provided by the washing machine. However, the dryer may additionally perform an operation of checking the laundry amount to compare the difference between the detected laundry amount information and the received laundry amount information. Then, a drying operation may be performed based on the compared result. According to an example embodiment, when the laundry amount corresponding to a single shirt is identified, the drying process may be performed for a time corresponding thereto. In addition, the drying time may vary depending on the ambient temperature, and more specifically, when the temperature decreases, the drying time may be set longer. This is because drying performance may vary depending on heat exchange with outside air in a heat pump type dryer. As the ambient temperature is low, drying performance is degraded and there is a need to perform drying for a longer time. In addition, according to an example, when a larger laundry amount than the laundry amount corresponding to the first mode is identified, a drying mode according to the corresponding laundry amount may be determined. More specifically, when a laundry amount exceeding the laundry amount corresponding to the first mode is detected, the drying operation may be performed while sensing the degree of drying instead of drying for a fixed time.

As describe above, the dryer receives information on the washing mode and the laundry amount from the washing machine, receives information related to the preheating operation and stopping according to the washing process, and prepares for the drying operation in response thereto. Thus, time spent on the entire washing and drying may be saved, and the usability may be improved. In addition, by including a separate setting procedure to control the operation of the laundry treatment apparatus through the user terminal in the example embodiment, it is possible to prevent the laundry treatment apparatus from being controlled by an external terminal in an environment that the user does not want.

Figure 8:
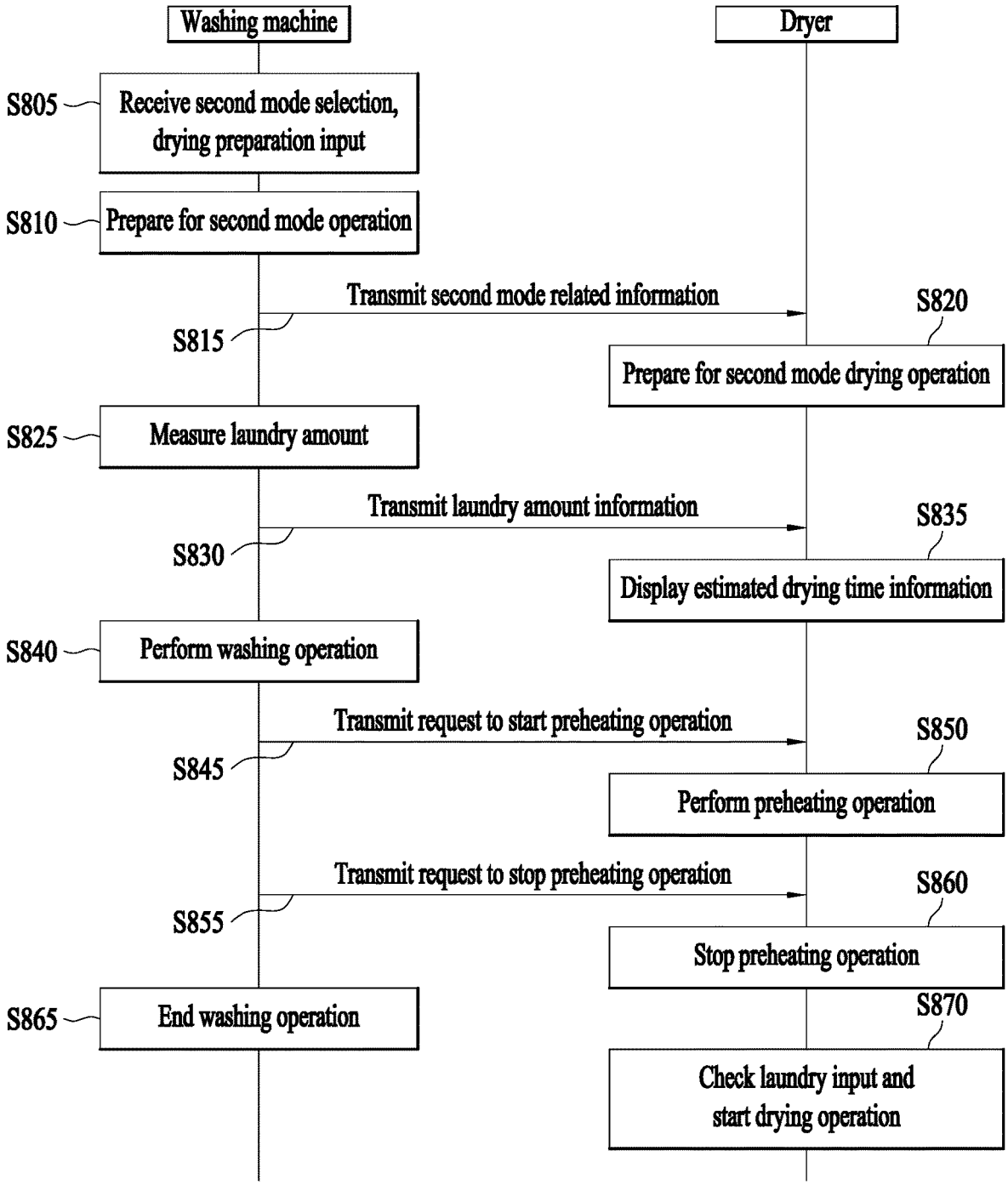
FIG. 8 is a diagram illustrating an operation method of a laundry treatment apparatus according to another example embodiment of the present disclosure.

FIG. 8 is a diagram illustrating an operation method of a laundry treatment apparatus according to another example embodiment of the present disclosure.

Referring to FIG. 8, a method of controlling an operation of a laundry treatment apparatus including a washing machine and a dryer is illustrated. The description is made based on a laundry treatment apparatus including a washing machine and a dryer, but it is not limited thereto, and the present example embodiment may be applied when the washing machine and the dryer may communicate with each other.

In operation S805, the washing machine may receive at least one of a second mode selection input and a drying preparation input. In an example embodiment, the second mode may correspond to a small amount rapid washing mode in which a small amount of laundry is washed, but is not limited thereto. In the case of the drying preparation input, when a corresponding input is received, the washing machine may have a drying preparation operation performed through communication with the dryer according to the progress of the washing operation. Upon receiving such an input, related information may be transmitted to the dryer according to the subsequent washing progress.

In operation S810, the washing machine may prepare for the second mode operation based on the received information. As an example, the display may be turned on in response to the received information, and the display may indicate that washing is performed in connection with the second mode.

In operation S815, the washing machine may transmit information related to the second mode to the dryer. For example, the washing machine may transmit information about this while performing an operation corresponding to the second mode. For example, course identification information related to the second mode may be transmitted from the washing machine to the dryer.

In operation S820, the dryer may prepare for an operation corresponding to the second mode based on the received information. For example, the dryer may turn on the display and the display may indicate that a drying operation corresponding to the second mode operating in the washing machine is performed. For example, when a small amount rapid washing course is performed, the washing machine may transmit information to the dryer in response to the display on in response to the corresponding mode, and the dryer may also indicate on the display that the drying operation is scheduled to be performed. As described above, the dryer also prepares to operate in response to the operation of the washing machine, so that the user may instruct a corresponding course through the user terminal and check the operation preparation state through both the washing machine and the dryer.

In operation S825, the washing machine may measure the amount of laundry. In an example embodiment, the washing machine may rotate a drum according to a specific pattern and measure the amount of laundry based on torque information according to the rotation. The amount of laundry may be a parameter considered for performing a washing process in a washing machine and a drying process in a dryer.

In operation S830, the washing machine may transmit the laundry amount information to the dryer. Meanwhile, in an example embodiment, information transmitted in operations S815 and S830 may be transmitted from the washing machine to the dryer at a time.

In operation S835, the dryer may display information on an estimated drying time for the target laundry based on the received laundry amount information. In an example embodiment, the estimated drying time may be displayed, and the dryer may turn on only some components including the display part, and wait to turn on at least some of the remaining components in response to a preheating preparation signal to be received later. The information displayed in the example embodiment may include at least one of a time required for drying, a time required for washing and drying, and time information at which drying is expected to be completed. In addition, in an example embodiment, the dryer may prepare for the preheating operation while displaying information about the estimated drying time. The dryer may perform a preheating operation for the dryer when receiving a triggering signal according to the progress of the washing process of the washing machine. Meanwhile, in the example embodiment, when the laundry amount is more than a certain amount, the dryer may perform sensing drying, and in this case, the estimated drying time may not be displayed or may be displayed as a preset value to be provided to the user, along with information that sensing drying is performed. In an example embodiment, the reference values of the laundry amount of the first mode and the second mode may be applied differently, and more details may be described later.

In operation S840, the washing machine may perform a washing operation. More specifically, at least one of water supply, washing, rinsing, drainage, and dehydration operations may be performed, and each operation may be performed at least once. The washing machine may check the remaining time according to the progress of the washing operation, and the remaining time information may be determined based on the laundry amount. In an example embodiment, the washing machine may check information necessary for preheating the dryer, which may be stored in the washing machine as preset information or acquired by the washing machine by an external signal.

In operation S845, the washing machine may transmit a request to start a preheating operation to the dryer based on the remaining time for washing. For example, the washing machine may transmit a preheating operation start request to the dryer at a timing determined based on a time required for preheating of the dryer and a remaining time of washing. In one example, information indicating when to start the preheating operation may be transmitted to the dryer.

In operation S850, the dryer may perform a preheating operation based on the received information. In an example embodiment, the dryer may operate at least one of a fan and a compressor to perform a preheating operation for performing drying. When performing such a preheating operation, hot air may circulate within the drum, and the circulated air may be heated through heat exchange with a heat exchanger of the dryer. As described in the previous example embodiment, the dryer may control a configuration that operates to maintain a temperature range suitable for preheating.

In operation S855, the washing machine may transmit a request to stop the preheating operation to the dryer in response to the progress of the washing operation. For example, when the end of the washing operation is imminent, it is expected that the user may take out the laundry from the washing machine and put it into the dryer. If the temperature in the drum is higher than necessary due to the preheating operation of the dryer or the circulation of hot air continues, inconvenience to the user may be expected. Accordingly, the washing machine may transmit the request to stop the preheating operation to the dryer. More specifically, the washing machine may transmit the request to stop the preheating operation to the dryer during the dehydration operation. For example, the washing machine may transmit the request to stop the preheating operation to the dryer 1 minute before the end of the dehydration. In addition, information indicating that the end of the washing process is imminent may be transmitted to the user terminal. Through this, when the user is away from the washing machine, the user may receive the corresponding information through the terminal and prepare to take out the laundry from the washing machine.

In operation S860, the dryer may stop the preheating operation based on the received information. In one example, the dryer may stop operating at least one of the fan and the compressor.

In operation S865, the washing machine may complete the washing operation, and may provide an alarm for completion to the user through an output part of the washing machine or a user terminal. Through such an alarm, the user may take the laundry out of the washing machine and put it into the dryer.

In operation S870, the dryer may check the input laundry and perform a drying operation corresponding thereto. For example, a drying operation may be performed based on at least a part of information received from the washing machine. More specifically, when the laundry amount corresponding to the second mode is identified, the drying operation may be performed accordingly. In one example, a drying operation may be performed based on the laundry amount information provided by the washing machine. However, the dryer may additionally perform an operation of checking the laundry amount to compare the difference between the detected laundry amount information and the received laundry amount information. Then, a drying operation may be performed based on the compared result. According to an example embodiment, when the laundry amount corresponding to a small amount rapid washing course is identified, the drying process may be performed for a time corresponding thereto. In addition, the drying time may vary depending on the ambient temperature, and more specifically, when the temperature decreases, the drying time may be set longer. This is because drying performance may vary depending on heat exchange with outside air in the heat pump type dryer. As the ambient temperature is low, drying performance is degraded and there is a need to perform drying for a longer time. In addition, according to an example, when a larger laundry amount than the laundry amount corresponding to the second mode is identified, a drying mode according to the corresponding laundry amount may be determined. More specifically, when a laundry amount exceeding the laundry amount corresponding to the second mode is detected, the drying operation may be performed while sensing the degree of drying instead of drying for a fixed time. In an example embodiment, the laundry amount corresponding to the second mode may be greater than the laundry amount corresponding to the first mode, and when a laundry amount exceeding the laundry amount corresponding to the second mode is identified, sensing drying may be performed.

Meanwhile, in an example embodiment, the washing machine may transmit information related to the dryer when a drying preparation input is received by the washing machine. More specifically, when the second mode is selected and the drying preparation input is selected, related information may be transmitted to the dryer for interlocking with the dryer.

In the course corresponding to the second mode for washing a small amount of laundry as described above, the washing machine interlocks with the dryer to transmit information on the amount of laundry checked by the washing machine and information on the course performed by the washing machine to the dryer, and the dryer receives such information to perform a preheating operation for drying. Accordingly, the total time required for washing and drying may be reduced. In addition, in the case of a washing machine rather than a dryer, it is possible to measure the laundry amount before water is absorbed into the laundry, and detect the laundry amount more accurately through the washing process. By passing this information to the dryer, the dryer may approximate the estimated time required for drying more accurately.

Meanwhile, in an example embodiment, the first reference value, which is the reference value of the laundry amount corresponding to the first mode, and the second reference value, which is the reference value of the laundry amount corresponding to the second mode, may be set to different values, and the first reference value may be smaller than the second reference value. In addition, when the laundry amount corresponding to the first mode is put into the dryer, the drying time may be shorter than when the laundry amount corresponding to the second mode is put into the dryer.

By changing the dryer interlocking method according to the mode set as described above and performing drying in a different way, dryer usability may be improved.

Figure 9:
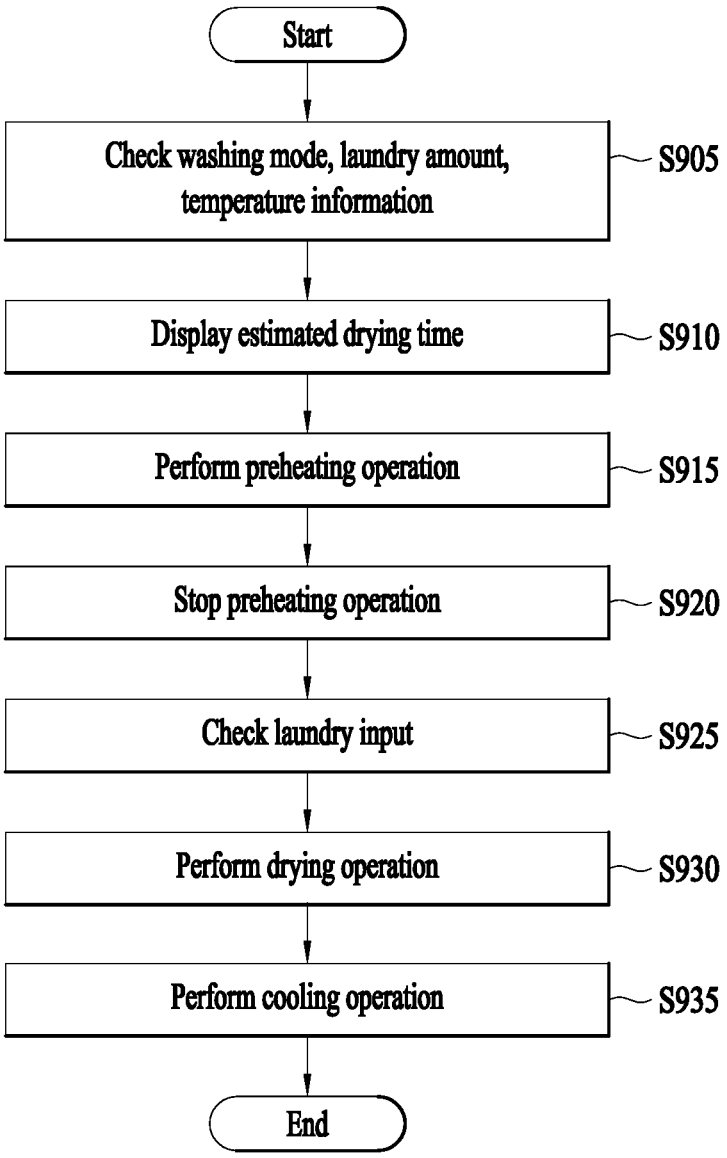
FIG. 9 is a diagram illustrating an operation method of a dryer according to an example embodiment of the present disclosure.

FIG. 9 is a diagram illustrating an operation method of a dryer according to an example embodiment of the present disclosure.

Referring to FIG. 9, a control method of a dryer performing a drying operation through interlocking with a washing machine according to an example embodiment is illustrated.

In operation S905, the dryer may check at least one of the washing mode and the laundry amount based on the information received from the washing machine, and may check temperature information around the dryer. In an example embodiment, the information received from the washing machine may provide relevant information to the dryer when the washing machine operates in a mode that interlocks with the dryer, and the dryer may receive the corresponding information to check at least one of washing mode information and laundry amount information. For example, modes in which the washing machine operates in conjunction with the dryer may include a first mode and a second mode, and a reference laundry amount corresponding to each mode may be set as a first reference laundry amount and a second reference laundry amount, respectively. In addition, the dryer may adjust the drying time performed in each course through the ambient temperature information.

In operation S910, the dryer may display the estimated drying time. In an example embodiment, when receiving related information from the washing machine, the dryer may display the estimated drying time even before starting the preheating operation. In an example embodiment, the estimated drying time may be a time expected to take until drying is completed after the laundry is put into the dryer, and may be determined according to the washing mode, the laundry amount, and the ambient temperature.

For example, when the washing machine is set to the first mode, and the reference laundry amount is less than or equal to the first reference laundry amount, drying for a fixed time with temperature correction applied may be performed based on the first reference time. When the washing machine is set to the second mode, and the reference laundry amount is less than or equal to the second reference laundry amount, drying for a fixed time with temperature correction applied may be performed based on the second reference time. In an example embodiment, the first reference laundry amount may be a value smaller than the second reference laundry amount, and the first reference time may be a value smaller than the second reference time. In addition, in the example embodiment, when the laundry amount exceeding the respective reference laundry amounts is detected in at least one of the first mode and the second mode, the dryer may perform drying while sensing the drying degree. Accordingly, the drying time becomes more than the first standard time. The drying time may be extended up to the maximum required time (for example, 4 hours and 30 minutes).

In addition, the information about the temperature around the dryer may be considered to correct the drying time when the dryer performs a fixed-time drying based on the laundry amount. For example, when the ambient temperature is low, heat exchange efficiency may decrease, and drying for a longer period of time may be performed to show the same drying performance. For example, the drying time may be adjusted based on at least one reference temperature. In an example embodiment, the drying time may be adjusted based on the first reference temperature and the second reference temperature. For example, the first reference temperature may be 18° C., and the second reference temperature may be 10° C. For example, when the washing course of the first mode is set and the identified laundry amount is less than or equal to the first reference laundry amount, the estimated drying time may be 18 minutes when the detected ambient temperature is higher than the first reference temperature. When the temperature is between the first reference temperature and the second reference temperature, it may be 28 minutes, and when the temperature is lower than the second reference temperature, it may be 32 minutes. By correcting the drying time of the fixed-time drying based on the reference temperature as described above, even when drying is performed in a low temperature environment, drying performance of a certain level or higher may be guaranteed.

In operation S915, the dryer may perform a preheating operation. The preheating operation may be performed by operating at least one of a compressor and a fan to increase the air temperature in the drum inside the dryer.

Meanwhile, the preheating operation may be performed based on a triggering signal of the washing machine, and the triggering signal may be transmitted at a specific timing based on a time required for drying preheating. In another example embodiment, the dryer may determine the start timing of the preheating operation based on at least one of washing mode information, laundry amount information, and temperature information without a separate triggering signal. By performing the preheating operation as described above, substantial drying process may be performed immediately after washing is completed in the washing machine and laundry is put into the dryer.

In operation S920, the dryer may stop the preheating operation. For example, the preheating operation may be stopped based on a triggering signal of the washing machine, and the triggering signal may be transmitted in response to the dehydration stroke. For example, the washing machine may transmit a signal requesting to stop the preheating operation to the dryer at a specific time before the dehydration stroke starts or the dehydration stroke is completed.

In operation S925, the dryer may identify that laundry is put into the drum. For example, when the dryer receives an input related to drying start after the user inserts laundry into the dryer, it may be identified that laundry is put into the drum.

In operation S930, the dryer may perform a drying operation, and may perform a drying operation corresponding to the washing mode, the laundry amount, and the ambient temperature. For example, drying may be performed by driving a compressor and circulating high-temperature wind generated by a heat pump and a fan into a dryer drum, and the drum rotates during the drying operation to mix the laundry inside.

When the time set in operation S935 elapses and the set drying degree is satisfied, the dryer may perform a cooling operation after the drying operation. The cooling operation may be performed so that the user does not experience inconvenience due to hot air generated during drying when the user takes out the dried laundry. The cooling time may be determined based on at least one of a washing mode and a laundry amount. In addition, cleaning of the condenser inside the dryer may be selectively performed in response to the cooling operation. Condenser cleaning may be performed using condensed water generated according to the operation of the heat pump, and, in another example, condenser cleaning may also be performed using water supplied from the outside.

As described above, the dryer performs a preheating operation through communication with the washing machine and a drying operation is performed based on information received from the washing machine. Accordingly, even when the dryer does not perform a separate detection of the amount of laundry, the corresponding drying may be performed to simplify the entire drying process. By performing preheating during the washing operation and performing a substantial drying operation immediately after washing is completed, the time required for the entire washing and drying may be reduced.

Figure 10:
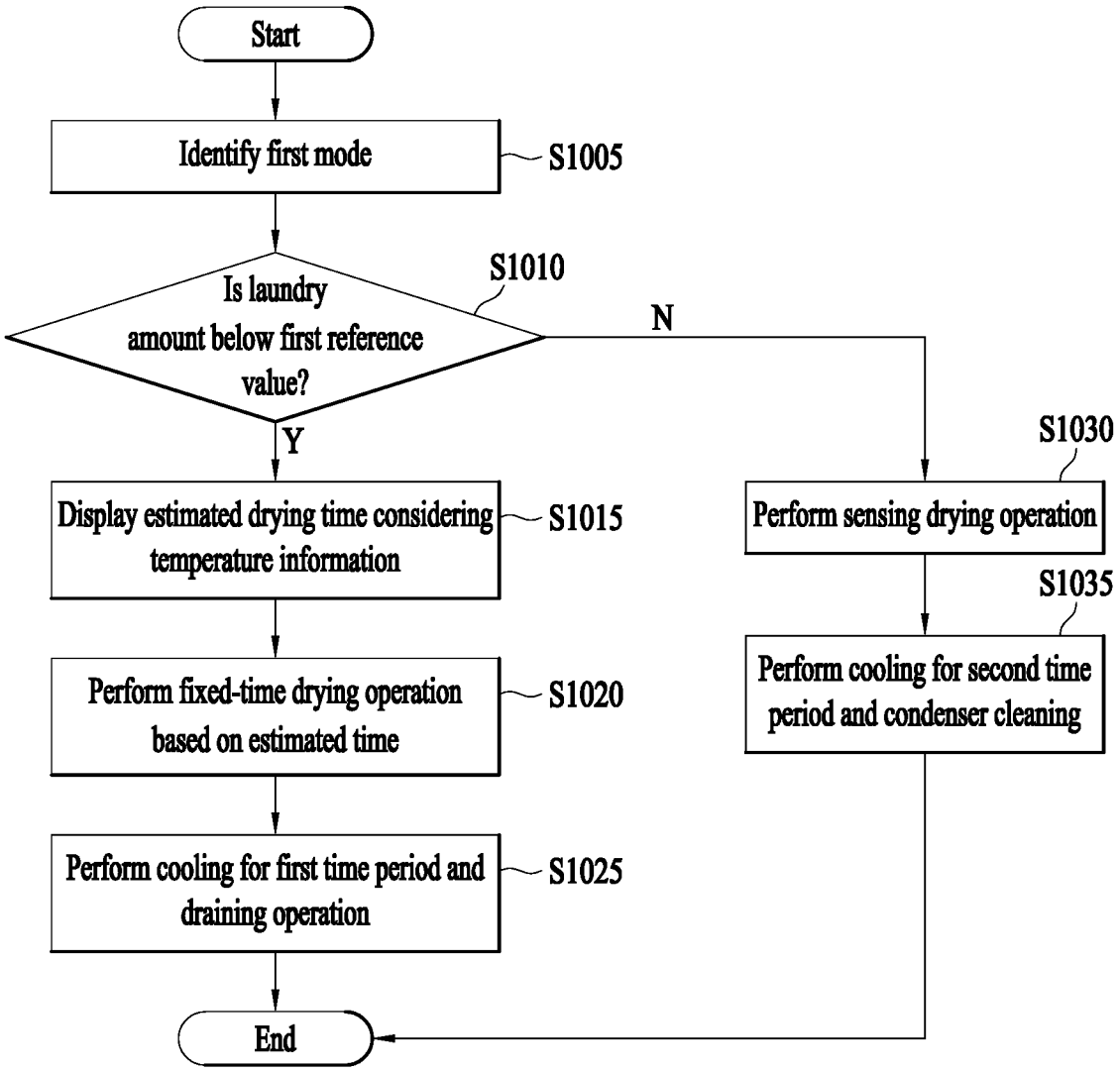
FIG. 10 is a diagram illustrating an operation method of a dryer in a first mode according to an example embodiment of the present disclosure.

FIG. 10 is a diagram illustrating a diagram illustrating an operation method of a dryer in a first mode according to an example embodiment of the present disclosure.

Referring to FIG. 10, a control method of the dryer operated in conjunction with the washing machine, which is set to the first mode and performing washing, is illustrated. In an example embodiment, the first mode may include a mode for quickly washing a small amount of laundry. For example, it may be a course for washing a very small amount of laundry such as a single shirt.

In operation S1005, the dryer may identify that the washing machine operates in the first mode. The dryer may identify that the washing machine operates in the first mode through communication with the washing machine, and check information on the amount of laundry put into the washing machine through communication with the washing machine.

In operation S1010, the dryer may check whether the laundry amount value is less than or equal to the first reference value. The first reference value may be the laundry amount value corresponding to the first mode. It may be a value smaller than the reference laundry amount value of the second mode to be described later, and, more specifically, a value of 90 to 95% of the reference laundry amount value of the second mode. Meanwhile, in the example embodiment, the comparison of the reference value for the laundry amount may be performed by comparing whether the laundry amount is smaller than the reference value based on a specific value, or may be performed in a manner of checking whether the laundry amount meets a specific range.

When the laundry amount value is less than or equal to the first reference value, in operation S1015, the dryer may display the estimated drying time in consideration of the ambient temperature information. In an example embodiment, the drying time may be displayed before the preheating operation. In addition, the dryer may perform a preheating operation through communication with the washing machine, which may be performed according to the operation of the previously described example embodiment.

In operation S1020, when laundry is put into the drum, the dryer may perform a fixed-time drying operation according to the indicated drying time. The drying operation may also be performed corresponding to the method described in the previous example embodiment.

When the drying operation is completed in operation S1025, the dryer may perform a cooling operation for a first time period, and may perform an operation of draining the condensed water collected therein. In an example embodiment, the first time period to perform cooling may be a time period corresponding to the first mode, and cooling may be performed for a longer time than a time required to discharge condensed water corresponding to the laundry amount of the first reference value. Meanwhile, according to an example embodiment, the condenser may be selectively cleaned together with the discharge of condensed water. In the case of drying laundry having the laundry amount value corresponding to the first mode, the amount of laundry is relatively small, and the amount of condensed water collected is also relatively small, so that the cooling time and the draining time may be short. In an example embodiment, when the drying time is shorter than or equal to a preset period of time, the draining operation of the condensed water may be performed without cleaning the condenser, and when it is longer than the preset period of time, the condenser cleaning may be performed.

When the laundry amount value is greater than the first reference value in operation S1010, the dryer may perform a sensing drying operation in operation S1030. The sensing drying operation may continuously perform drying until a required drying level is achieved while sensing the drying level of the laundry inside the dryer through a sensor. On the other hand, even when the sensing drying is performed, the estimated drying time may be displayed, but the total drying time may not correspond to this, and the drying time may be determined according to the drying degree sensed by the sensor.

When the drying degree satisfies the preset condition in operation S1035, the cooling operation may be performed for a second time period while the drying is terminated, and condenser cleaning may be performed using the condensed water collected during the drying process. In an example embodiment, when the laundry amount is more than the first reference value, a relatively large amount of laundry may maintain a high temperature during the drying process, so the cooling operation may be performed for a second time period longer than the first time period. Condensed water collected during the drying process may also be relatively larger, and condenser cleaning may be performed using the condensed water. In an example embodiment, if the laundry amount value is larger than the first reference value, the drying time may increase, and information related thereto may be provided to the user.

As described above, even when the washing machine interlocked with the dryer operates in the first mode, the dryer performs a corresponding drying operation using the laundry amount information, thereby ensuring drying performance even when the user inserts more laundry than the laundry amount suitable for the corresponding mode and improving the usability.

Figure 11:
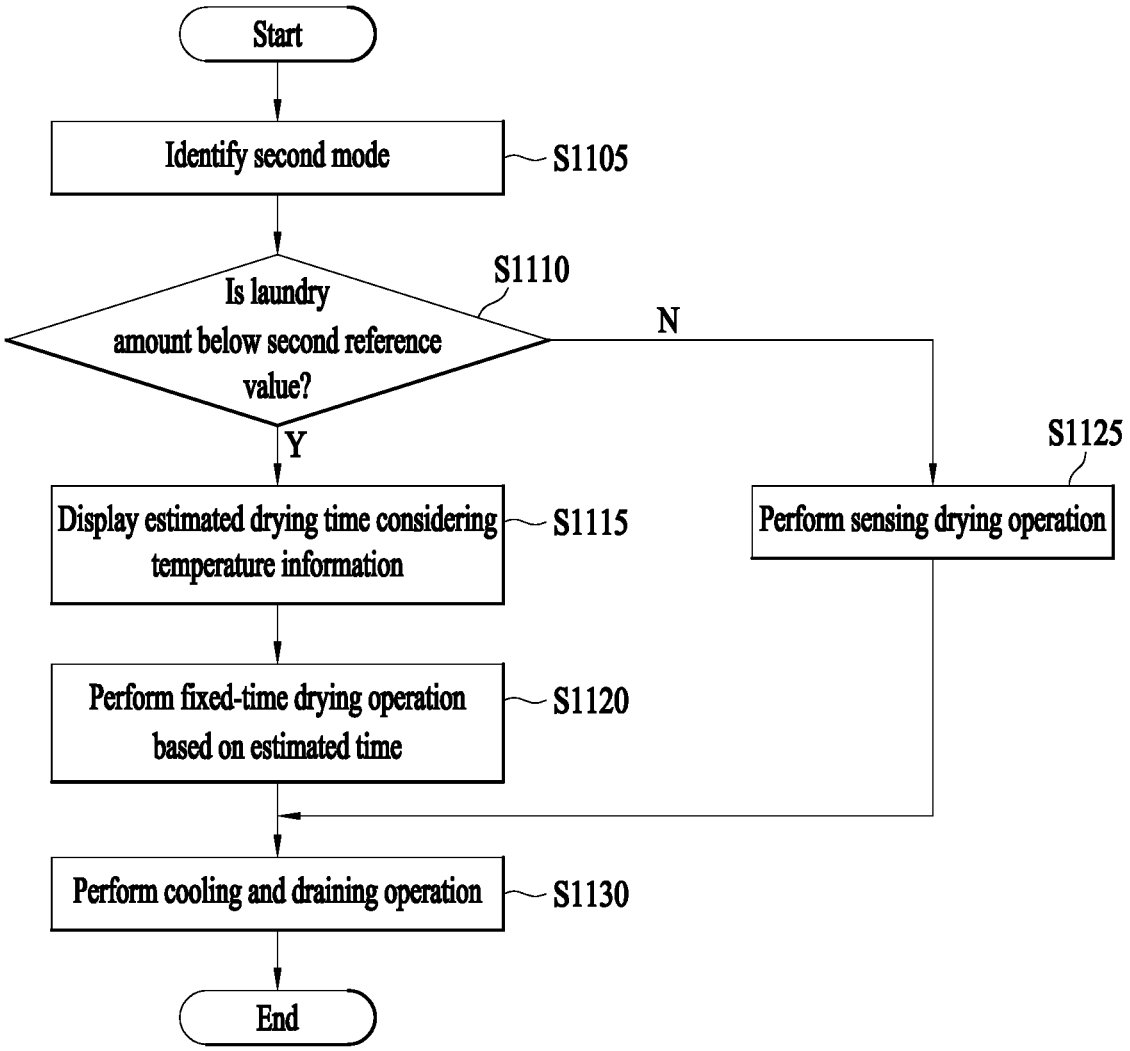
FIG. 11 is a diagram illustrating an operation method of a dryer in a second mode according to an example embodiment of the present disclosure.

FIG. 11 is a diagram illustrating a diagram illustrating an operation method of a dryer in a second mode according to an example embodiment of the present disclosure.

Referring to FIG. 11, a control method of the dryer operated in conjunction with the washing machine, which is set to the second mode and performing laundry, is illustrated. In an example embodiment, the second mode may include a mode for quickly washing a small amount of laundry, and the laundry amount corresponding to the second mode may be larger than the laundry amount corresponding to the first mode.

In operation S1105, the dryer may identify that the washing machine operates in the second mode. The dryer may identify that the washing machine operates in the second mode through communication with the washing machine, and check information on the amount of laundry put into the washing machine through communication with the washing machine.

In operation S1110, the dryer may check whether the laundry amount value is less than or equal to the second reference value. The second reference value may be the laundry amount value corresponding to the second mode, and may be a value larger than the reference laundry amount value of the first mode described above.

When the laundry amount value is less than or equal to the second reference value, in operation S1115, the dryer may display the estimated drying time in consideration of the ambient temperature information. In an example embodiment, the drying time may be displayed before the preheating operation. In addition, the dryer may perform a preheating operation through communication with the washing machine, which may be performed according to the operation of the previously described example embodiment. More specifically, it will now be described on the basis that the laundry amount value is less than the second reference value. When the detected ambient temperature is greater than or equal to the first reference temperature, the drying time may be 39 minutes. It may be 48 minutes at the temperature between the first and second reference temperatures, and 52 minutes at the temperature below the second reference temperature.

In operation S1120, when laundry is put into the drum, the dryer may perform a fixed-time drying operation according to the indicated drying time. The drying operation may also be performed corresponding to the method described in the previous example embodiment.

When the laundry amount value is greater than the second reference value in operation S1110, the dryer may perform a sensing drying operation in operation S1125. The sensing drying operation may continuously perform drying until a required drying level is achieved while sensing the drying level of the laundry inside the dryer through a sensor. On the other hand, even when the sensing drying is performed, the estimated drying time may be displayed, but the total drying time may not correspond to this, and the drying time may be determined according to the drying degree sensed by the sensor.

When the drying operation ends in each drying mode, the dryer may perform cooling and drainage operations in operation S1130. More specifically, the dryer may perform a cooling operation while completing drying, perform condenser cleaning using condensed water collected during the drying process, and drain the condensed water used for performing cleaning.

When the second mode is selected as described above, the drying method is performed differently according to the detected laundry amount, so that the drying performance may be guaranteed even when more laundry is inserted than that for the mode selected by the user.

Example embodiments of the present disclosure have been disclosed in the present specification and drawings. Although specific terms are used, these are only used in general meaning to easily explain the technical content of the present disclosure and to aid understanding of the present disclosure, but not intended to limit the scope of the present disclosure. It is obvious to those skilled in the art that other modified examples based on the technical idea of the present disclosure can be implemented in addition to the example embodiments disclosed herein.

What is claimed is:

1. A method of controlling a washing machine, the method comprising:

receiving setting information for a washing mode;

sensing an amount of laundry received into the washing machine;

transmitting, to a dryer, (i) the setting information for the washing mode and (ii) information on the amount of laundry;

transmitting, to the dryer, a request to start preheating operation; and transmitting, to the dryer, a request to stop the preheating operation before an operation of the washing machine is completed.

2. The method of claim 1, wherein transmitting, to the dryer, the request to start the preheating operation comprises:

transmitting, to the dryer, the request to start the preheating operation between a first time when a drain stroke of the washing machine is completed and a second time when a dehydration stroke of the washing machine is completed, to cause the dryer to preheat at a configured temperature.

3. The method of claim 1, wherein receiving setting information for the washing mode comprises:

receiving, using an input device of the washing machine, a remote control input for setting remote control of the washing machine; and receiving, via a remote terminal and based on the remote control input, the setting information for the washing mode, wherein the remote terminal is configured to communicate with the washing machine.

4. The method of claim 2, wherein transmitting, to the dryer, the request to stop the preheating operation comprises:

transmitting, to the dryer and based on the dehydration stroke of the washing machine being ended, the request to stop the preheating operation.

5. The method of claim 1, further comprising:

performing, at the washing machine, a dehydration stroke on the received laundry; and transmitting, from the washing machine to the dryer and during the dehydration stroke, the request to stop the preheating operation.

6. The method of claim 1, wherein (i) the setting information for the washing mode and (ii) the information on the amount of laundry are configured to cause the dryer to set a drying time.

7. A laundry treating apparatus comprising:

a washing machine including a rotatable drum configured to receive laundry; and a controller configured to perform operations comprising:

receiving setting information for a washing mode through a washing machine interface, detecting an amount of laundry received into the drum, transmitting, to a dryer, (i) the setting information for washing mode and (ii) information on the amount of laundry, transmitting, to the dryer, a request to start preheating operation after a drainage stroke of the washing machine, and transmitting, to the dryer and based on a dehydration stroke of the washing machine being ended, a request to stop preheating operation.

8. The laundry treating apparatus of claim 7, wherein transmitting, to the dryer, the request to start the preheating operation comprises:

transmitting, to the dryer, the request to start the preheating operation between a start time point of the dehydration stroke and an end time point of the dehydration stroke.

9. The laundry treating apparatus of claim 8, wherein transmitting, to the dryer, the request to stop the preheating operation comprises:

transmitting, to the dryer and based on the dehydration stroke of the washing machine being ended, the request to stop preheating operation.

10. The laundry treating apparatus of claim 7, wherein the preheating operation includes a supply stoke in which a dryer controller operates a fan to supply air to a drying drum, and a heating stoke in which the dryer controller operates a heat exchanger to heat the air supplied to the drying drum; and wherein, based on the temperature of the air being greater than a reference temperature during the preheating operation, the supplying stroke is maintained and the heating stroke is suspended.

* * * * *